US008616836B2

(12) United States Patent
Blair et al.

(10) Patent No.: US 8,616,836 B2
(45) Date of Patent: Dec. 31, 2013

(54) DIFFUSER USING DETACHABLE VANES

(75) Inventors: Noel Blair, Grand Island, NY (US); Charles F. Herr, Amherst, NY (US); David N. O'Neill, Tonawanda, NY (US)

(73) Assignee: Cameron International Corporation, Houston, TX (US)

( * ) Notice: Subject to any disclaimer, the term of this patent is extended or adjusted under 35 U.S.C. 154(b) by 742 days.

(21) Appl. No.: 12/839,290

(22) Filed: Jul. 19, 2010

(65) Prior Publication Data

US 2012/0014788 A1 Jan. 19, 2012

(51) Int. Cl.
*F04D 15/00* (2006.01)

(52) U.S. Cl.
USPC ..... 415/148; 415/159; 415/208.3; 415/209.2; 415/209.4; 415/211.1; 416/204 R; 416/207

(58) Field of Classification Search
USPC ..... 415/148, 159, 165, 208.1, 208.2, 208.3, 415/209.2, 209.3, 209.4, 210.1, 211.1, 415/211.2, 213.1; 416/204 R, 207
See application file for complete search history.

(56) References Cited

U.S. PATENT DOCUMENTS

| | | | | |
|---|---|---|---|---|
| 2,372,880 | A | 4/1945 | Browne | |
| 3,038,698 | A * | 6/1962 | Troyer | 415/12 |
| 3,489,339 | A * | 1/1970 | Greenwald | 415/163 |
| 3,495,921 | A | 2/1970 | Swearingen | |
| 4,054,398 | A | 10/1977 | Penny | |
| 4,527,949 | A * | 7/1985 | Kirtland | 415/150 |
| 4,726,744 | A * | 2/1988 | Arnold | 417/407 |
| 5,452,986 | A | 9/1995 | Osborne et al. | |
| 7,448,852 | B2 | 11/2008 | Abdelwahab et al. | |
| 2008/0038114 | A1 | 2/2008 | Abdelwahab et al. | |
| 2009/0311095 | A1 | 12/2009 | Blewett et al. | |

FOREIGN PATENT DOCUMENTS

| | | | |
|---|---|---|---|
| DE | 3424925 | C1 | 10/1985 |
| DE | 4438611 | A1 | 5/1996 |
| FR | 459801 | | 11/1913 |
| GB | 138404 | A | 2/1920 |
| GB | 985743 | A | 3/1965 |
| JP | 5044693 | A | 2/1993 |
| WO | WO9519499 | | 7/1995 |
| WO | 2008/023034 | A1 | 2/2008 |
| WO | PCT/US10/42474 | | 7/2010 |

OTHER PUBLICATIONS

U.S. Appl. No. 12/839,320, filed Jul. 19, 2010, Small et al.

* cited by examiner

*Primary Examiner* — Igor Kershteyn
(74) *Attorney, Agent, or Firm* — Fletcher Yoder, P.C.

(57) ABSTRACT

A system, in certain embodiments, includes a plurality of detachable, three-dimensional diffuser vanes attached to a diffuser plate of a centrifugal compressor. In certain embodiments, the detachable, three-dimensional diffuser vanes may be attached to the diffuser plate using threaded fasteners. In addition, dowel pins may be used to align the detachable, three-dimensional diffuser vanes with respect to the diffuser plate. However, in other embodiments, the detachable, three-dimensional diffuser vanes may include a tab configured to fit securely within a groove in the diffuser plate. In addition, the tabs of the detachable, three-dimensional diffuser vanes may include indentions that mate with extensions extending from the diffuser plate, wherein the tabs may slide into slots between the extensions and the grooves of the diffuser plate.

23 Claims, 14 Drawing Sheets

DIFFUSER USING DETACHABLE VANES

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Centrifugal compressors may be employed to provide a pressurized flow of fluid for various applications. Such compressors typically include an impeller that is driven to rotate by an electric motor, an internal combustion engine, or another drive unit configured to provide a rotational output. As the impeller rotates, fluid entering in an axial direction is accelerated and expelled in a circumferential and a radial direction. The high-velocity fluid then enters a diffuser which converts the velocity head into a pressure head (i.e., decreases flow velocity and increases flow pressure). In this manner, the centrifugal compressor produces a high-pressure fluid output. Unfortunately, there is a tradeoff between performance and efficiency in existing diffusers.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
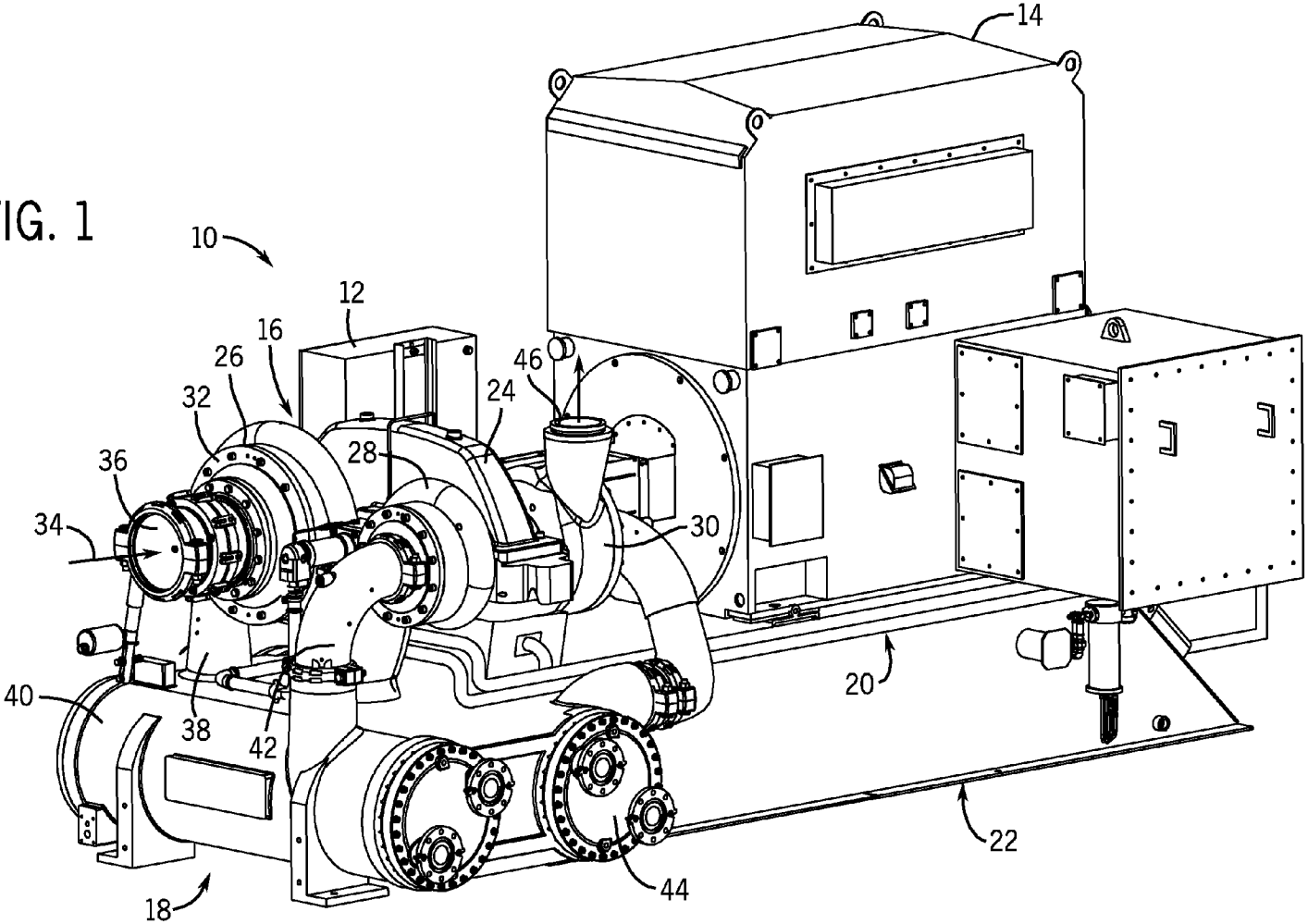
FIG. 1 is a perspective view of an exemplary embodiment of a compressor system employing a diffuser with detachable vanes.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In certain configurations, a diffuser includes a series of vanes configured to enhance diffuser efficiency. Certain diffusers may include three-dimensional airfoil-type vanes or two-dimensional cascade-type vanes. The airfoil-type vanes provide a greater maximum efficiency, but decreased performance within surge flow and choked flow regimes. In contrast, cascade-type vanes provide enhanced surge flow and choked flow performance, but result in decreased maximum efficiency compared to airfoil-type vanes.

Embodiments of the present disclosure may increase diffuser efficiency and reduce surge flow and choked flow losses by employing three-dimensional non-airfoil diffuser vanes particularly configured to match flow variations from an impeller. In certain embodiments, each diffuser vane includes a tapered leading edge, a tapered trailing edge and a constant thickness section extending between the leading edge and the trailing edge. A length of the constant thickness section may be greater than approximately 50% of a chord length of the diffuser vane. A radius of curvature of the leading edge, a radius of curvature of the trailing edge, and the chord length may be configured to vary along a span of the diffuser vane. In this manner, the diffuser vane may be particularly adjusted to compensate for axial flow variations from the impeller. In further configurations, a camber angle of the diffuser vane may also be configured to vary along the span. Other embodiments may enable a circumferential position of the leading edge and/or the trailing edge of the diffuser vane to vary along the span of the vane. Such adjustment may facilitate a non-airfoil vane configuration that is adjusted to coincide with the flow properties of a particular impeller, thereby increasing efficiency and decreasing surge flow and choked flow losses.

However, the three-dimensional diffuser vanes described herein may not be particularly suitable for being manufactured using conventional five-axis (e.g., x, y, z, rotation, and tilt) machining techniques. In particular, the complex three-dimensional contours of the diffuser vanes may be difficult to machine using conventional techniques, which usually involve straight extrusion of two-dimensional profiles. Therefore, as described in greater detail below, the diffuser vanes may be designed as detachable from the diffuser plate, enabling machining of the detachable diffuser vanes separate from the diffuser plate. However, in the disclosed embodiments with the detachable diffuser vanes manufactured separate from the diffuser plate, the detachable diffuser vanes may be attached to the diffuser plate after machining. As described below, in certain embodiments, the detachable diffuser vanes may be configured to attach to the diffuser plate using various fasteners and dowel pins. In other embodiments, the detachable diffuser vanes may have tabbed ends that are configured to be inserted into grooves on the diffuser plate. In yet other embodiments, these tab/groove embodiments may be extended to include slots in the diffuser plate into which the tabbed diffuser vanes may be slid before attachment.

FIG. 1 is a perspective view of an exemplary embodiment of a compressor system 10 employing a diffuser with detachable vanes. The compressor system 10 is generally configured to compress gas in various applications. For example, the compressor system 10 may be employed in applications relating to the automotive industries, electronics industries, aerospace industries, oil and gas industries, power generation industries, petrochemical industries, and the like. In addition, the compressor system 10 may be employed to compress land fill gas, which may contain certain corrosive elements. For example, the land fill gas may contain carbonic acid, sulfuric acid, carbon dioxide, and so forth.

In general, the compressor system 10 includes one or more centrifugal gas compressors that are configured to increase the pressure of (e.g., compress) incoming gas. More specifically, the depicted embodiment includes a Turbo-Air 9000 manufactured by Cameron of Houston, Tex. However, other centrifugal compressor systems may employ a diffuser with detachable vanes. In some embodiments, the compressor system 10 includes a power rating of approximately 150 to approximately 3,000 horsepower (hp), discharge pressures of approximately 80 to 150 pounds per square inch (psig) and an output capacity of approximately 600 to 15,000 cubic feet per minute (cfm). Although the illustrated embodiment includes only one of many compressor arrangements that can employ a diffuser with detachable vanes, other embodiments of the compressor system 10 may include various compressor arrangements and operational parameters. For example, the compressor system 10 may include a different type of compressor, a lower horsepower rating suitable for applications having a lower output capacity and/or lower pressure differentials, a higher horsepower rating suitable for applications having a higher output capacity and/or higher pressure differentials, and so forth.

In the illustrated embodiment, the compressor system 10 includes a control panel 12, a drive unit 14, a compressor unit 16, an intercooler 18, a lubrication system 20, and a common base 22. The common base 22 generally provides for simplified assembly and installation of the compressor system 10. For example, the control panel 12, the drive unit 14, the compressor unit 16, intercooler 18, and the lubrication system 20 are coupled to the common base 22. This enables installation and assembly of the compressor system 10 as modular components that are pre-assembled and/or assembled on site.

The control panel 12 includes various devices and controls configured to monitor and regulate operation of the compressor system 10. For example, in one embodiment, the control panel 12 includes a switch to control system power, and/or numerous devices (e.g., liquid crystal displays and/or light emitting diodes) indicative of operating parameters of the compressor system 10. In other embodiments, the control panel 12 includes advanced functionality, such as a programmable logic controller (PLC) or the like.

The drive unit 14 generally includes a device configured to provide motive power to the compressor system 10. The drive unit 14 is employed to provide energy, typically in the form of a rotating drive unit shaft, which is used to compress the incoming gas. Generally, the rotating drive unit shaft is coupled to the inner workings of the compressor unit 16, and rotation of the drive unit shaft is translated into rotation of an impeller that compresses the incoming gas. In the illustrated embodiment, the drive unit 14 includes an electric motor that is configured to provide rotational torque to the drive unit shaft. In other embodiments, the drive unit 14 may include other motive devices, such as a compression ignition (e.g., diesel) engine, a spark ignition (e.g., internal gas combustion) engine, a gas turbine engine, or the like.

The compressor unit 16 typically includes a gearbox 24 that is coupled to the drive unit shaft. The gearbox 24 generally includes various mechanisms that are employed to distribute the motive power from the drive unit 14 (e.g., rotation of the drive unit shaft) to impellers of the compressor stages. For instance, in operation of the system 10, rotation of the drive unit shaft is delivered via internal gearing to the various impellers of a first compressor stage 26, a second compressor stage 28, and a third compressor stage 30. In the illustrated embodiment, the internal gearing of the gearbox 24 typically includes a bull gear coupled to a drive shaft that delivers rotational torque to the impeller.

It will be appreciated that such a system (e.g., where a drive unit 14 that is indirectly coupled to the drive shaft that delivers rotational torque to the impeller) is generally referred to as an indirect drive system. In certain embodiments, the indirect drive system may include one or more gears (e.g., gearbox 24), a clutch, a transmission, a belt drive (e.g., belt and pulleys), or any other indirect coupling technique. However, another embodiment of the compressor system 10 may include a direct drive system. In an embodiment employing the direct drive system, the gearbox 24 and the drive unit 14 may be essentially integrated into the compressor unit 16 to provide torque directly to the drive shaft. For example, in a direct drive system, a motive device (e.g., an electric motor) surrounds the drive shaft, thereby directly (e.g., without intermediate gearing) imparting a torque on the drive shaft. Accordingly, in an embodiment employing the direct drive system, multiple electric motors can be employed to drive one or more drive shafts and impellers in each stage of the compressor unit 16.

The gearbox 24 includes features that provide for increased reliability and simplified maintenance of the system 10. For example, the gearbox 24 may include an integrally cast multistage design for enhanced performance. In other words, the gearbox 24 may include a singe casting including all three scrolls helping to reduce the assembly and maintenance concerns typically associated with systems 10. Further, the gearbox 24 may include a horizontally split cover for easy removal and inspection of components disposed internal to the gearbox 24.

As discussed briefly above, the compressor unit 16 generally includes one or more stages that compress the incoming gas in series. For example, in the illustrated embodiment, the compressor unit 16 includes three compression stages (e.g., a three stage compressor), including the first stage compressor 26, the second stage compressor 28, and the third stage compressor 30. Each of the compressor stages 26, 28, and 30 includes a centrifugal scroll that includes a housing encompassing a gas impeller and associated diffuser with detachable vanes. In operation, incoming gas is sequentially passed into each of the compressor stages 26, 28, and 30 before being discharged at an elevated pressure.

Operation of the system 10 includes drawing a gas into the first stage compressor 26 via a compressor inlet 32 and in the direction of arrow 34. As illustrated, the compressor unit 16 also includes a guide vane 36. The guide vane 36 includes vanes and other mechanisms to direct the flow of the gas as it enters the first compressor stage 26. For example, the guide vane 36 may impart a swirling motion to the inlet air flow in the same direction as the impeller of the first compressor stage 26, thereby helping to reduce the work input at the impeller to compress the incoming gas.

After the gas is drawn into the system 10 via the compressor inlet 32, the first stage compressor 26 compresses and discharges the compressed gas via a first duct 38. The first duct 38 routes the compressed gas into a first stage 40 of the intercooler 18. The compressed gas expelled from the first compressor stage 26 is directed through the first stage intercooler 40 and is discharged from the intercooler 18 via a second duct 42.

Generally, each stage of the intercooler 18 includes a heat exchange system to cool the compressed gas. In one embodiment, the intercooler 18 includes a water-in-tube design that effectively removes heat from the compressed gas as it passes over heat exchanging elements internal to the intercooler 18. An intercooler stage is provided after each compressor stage to reduce the gas temperature and to improve the efficiency of each subsequent compression stage. For example, in the illustrated embodiment, the second duct 42 routes the compressed gas into the second compressor stage 28 and a second stage 44 of the intercooler 18 before routing the gas to the third compressor stage 30.

After the third stage 30 compresses the gas, the compressed gas is discharged via a compressor discharge 46. In the illustrated embodiment, the compressed gas is routed from the third stage compressor 30 to the discharge 46 without an intermediate cooling step (e.g., passing through a third intercooler stage). However, other embodiments of the compressor system 10 may include a third intercooler stage or similar device configured to cool the compressed gas as it exits the third compressor stage 30. Further, additional ducts may be coupled to the discharge 46 to effectively route the compressed gas for use in a desired application (e.g., drying applications).

Figure 2:
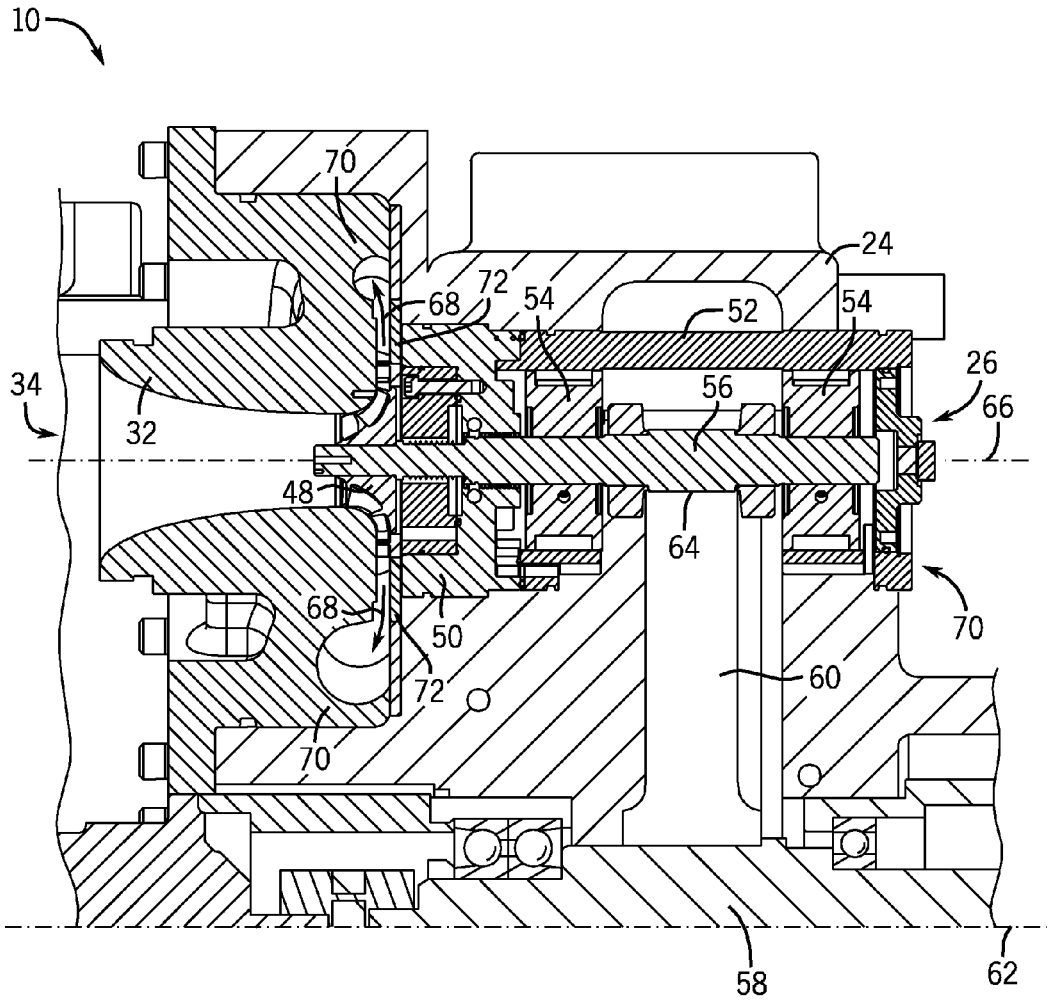
FIG. 2 is a cross-section view of an exemplary embodiment of a first compressor stage within the compressor system of FIG. 1.

FIG. 2 is a cross-section view of an exemplary embodiment of the first compressor stage 26 within the compressor system 10 of FIG. 1. However, the components of the first compressor stage 26 are merely illustrative of any of the compressor stages 26, 28, and 30 and may, in fact, be indicative of the components in a single stage compressor system 10. As illustrated in FIG. 2, the first compressor stage 26 may include an impeller 48, a seal assembly 50, a bearing assembly 52, two bearings 54 within the bearing assembly 52, and a pinion shaft 56, among other things. In general, the seal assembly 50 and the bearing assembly 52 reside within the gearbox 24. The two bearings 54 provide support for the pinion shaft 56, which drives rotation of the impeller 48.

In certain embodiments, a drive shaft 58, which is driven by the drive unit 14 of FIG. 1, may be used to rotate a bull gear 60 about a central axis 62. The bull gear 60 may mesh with the pinion shaft 56 of the first compressor stage 26 via a pinion mesh 64. In fact, the bull gear 60 may also mesh with another pinion shaft associated with the second and third compressor stages 28, 30 via the pinion mesh 64. Rotation of the bull gear 60 about the central axis 62 may cause the pinion shaft 56 to rotate about a first stage axis 66, causing the impeller 48 to rotate about the first stage axis 66. As discussed above, gas may enter the compressor inlet 32, as illustrated by arrow 34. The rotation of the impeller 48 causes the gas to be compressed and directed radially, as illustrated by arrows 68. As the compressed gas exits through a scroll 70, the compressed gas is directed across a diffuser 72, which converts the high-velocity fluid flow from the impeller 48 into a high pressure flow (e.g., converting the dynamic head to pressure head).

Figure 3:
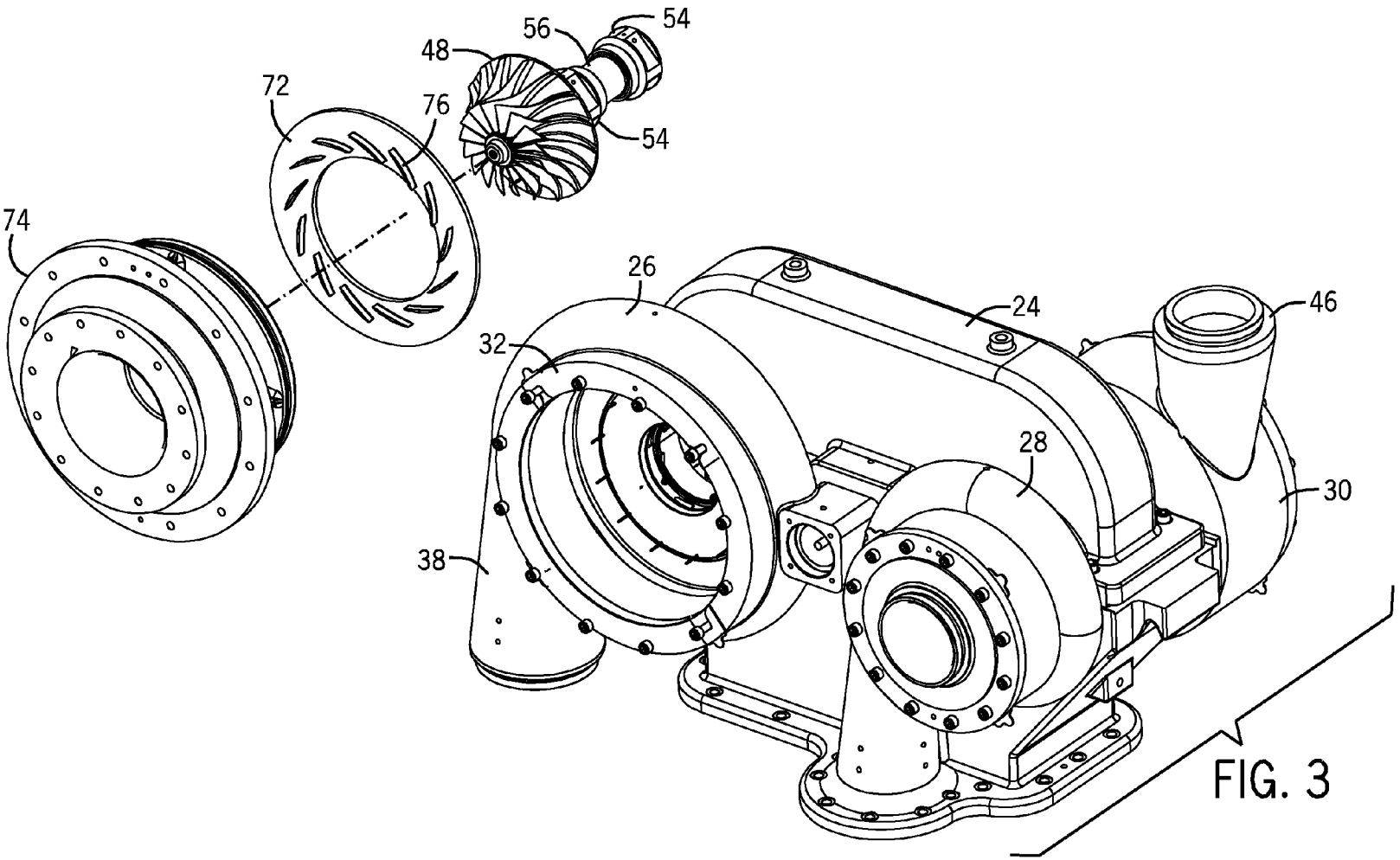
FIG. 3 is an exploded view illustrating certain components of the compressor system of FIG. 1.

FIG. 3 is an exploded view illustrating certain components of the compressor system 10 of FIG. 1. In particular, FIG. 3 illustrates an inlet assembly 74 of the first compressor stage 26 removed from the compressor inlet 32 and the diffuser 72 with detachable vanes 76 that is located radially about the diffuser 48, which is attached to the pinion shaft 56 as illustrated. In addition, the bearings 54 of the bearing assembly 52 are also illustrated. As described above, as the pinion shaft 56 causes the diffuser 48 to rotate, gas entering through the inlet assembly 74 will be compressed by the diffuser 48 and discharged through the first duct 38 of the first compressor stage 26. Before being discharged though the first duct 38, the compressed gas is directed across the diffuser 72.

Figure 4:
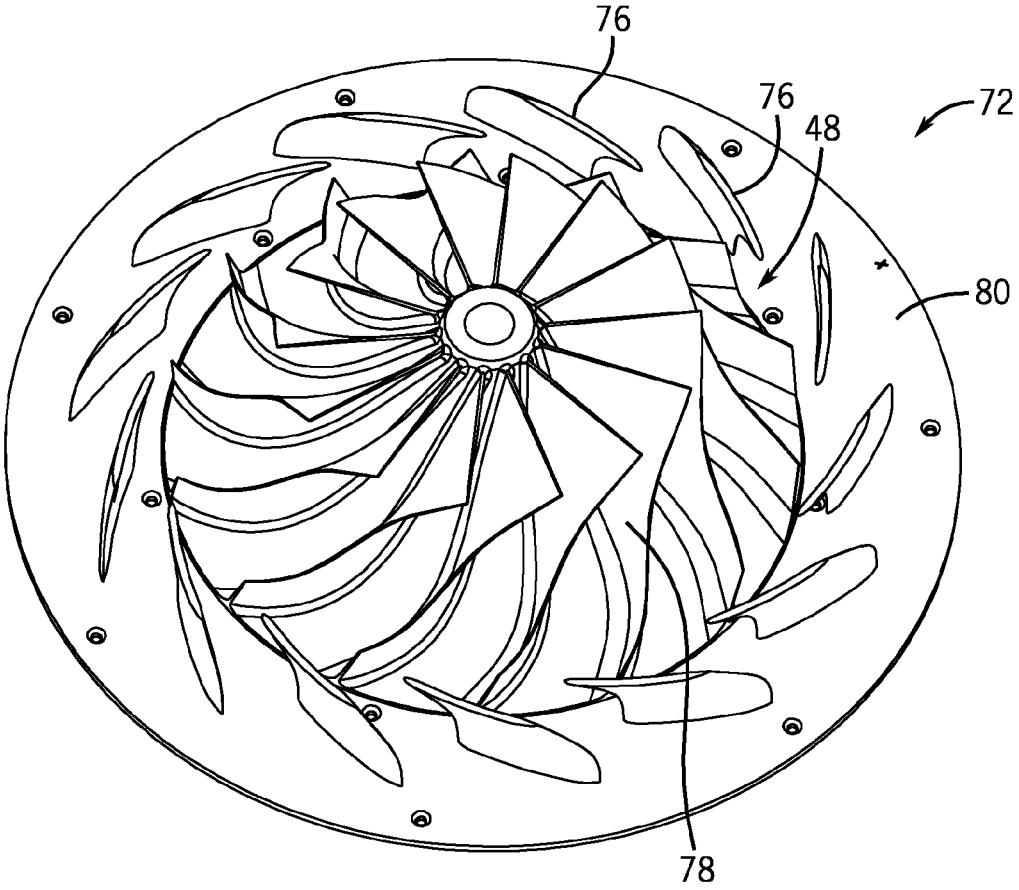
FIG. 4 is a perspective view of centrifugal compressor components including diffuser vanes having a constant thickness section and specifically contoured to match the flow characteristics of an impeller.

FIG. 4 is a perspective view of centrifugal compressor system 10 components configured to output a pressurized fluid flow. Specifically, the centrifugal compressor system 10 includes an impeller 48 having multiple blades 78. As the impeller 48 is driven to rotate by an external source (e.g., electric motor, internal combustion engine, etc.), compressible fluid entering the blades 78 is accelerated toward a diffuser 72 disposed about the impeller 48. In certain embodiments, a shroud (not shown) is positioned directly adjacent to the diffuser 72, and serves to direct fluid flow from the impeller 48 to the diffuser 72. The diffuser 72 is configured to convert the high-velocity fluid flow from the impeller 48 into a high pressure flow (e.g., convert the dynamic head to pressure head).

In the present embodiment, the diffuser 72 includes diffuser vanes 76 coupled to a plate 80 in an annular configuration. The vanes 76 are configured to increase diffuser efficiency. As discussed in detail below, each vane 76 includes a leading edge section, a trailing edge section and a constant thickness section extending between the leading edge section and the trailing edge section, thereby forming a non-airfoil vane 76. Properties of the vane 76 are configured to establish a three-dimensional arrangement that particularly matches the fluid flow expelled from the impeller 48. By contouring the three-dimensional non-airfoil vane 76 to coincide with impeller exit flow, efficiency of the diffuser 72 may be increased compared to two-dimensional cascade diffusers. In addition, surge flow and choked flow losses may be reduced compared to three-dimensional airfoil-type diffusers.

Figure 5:
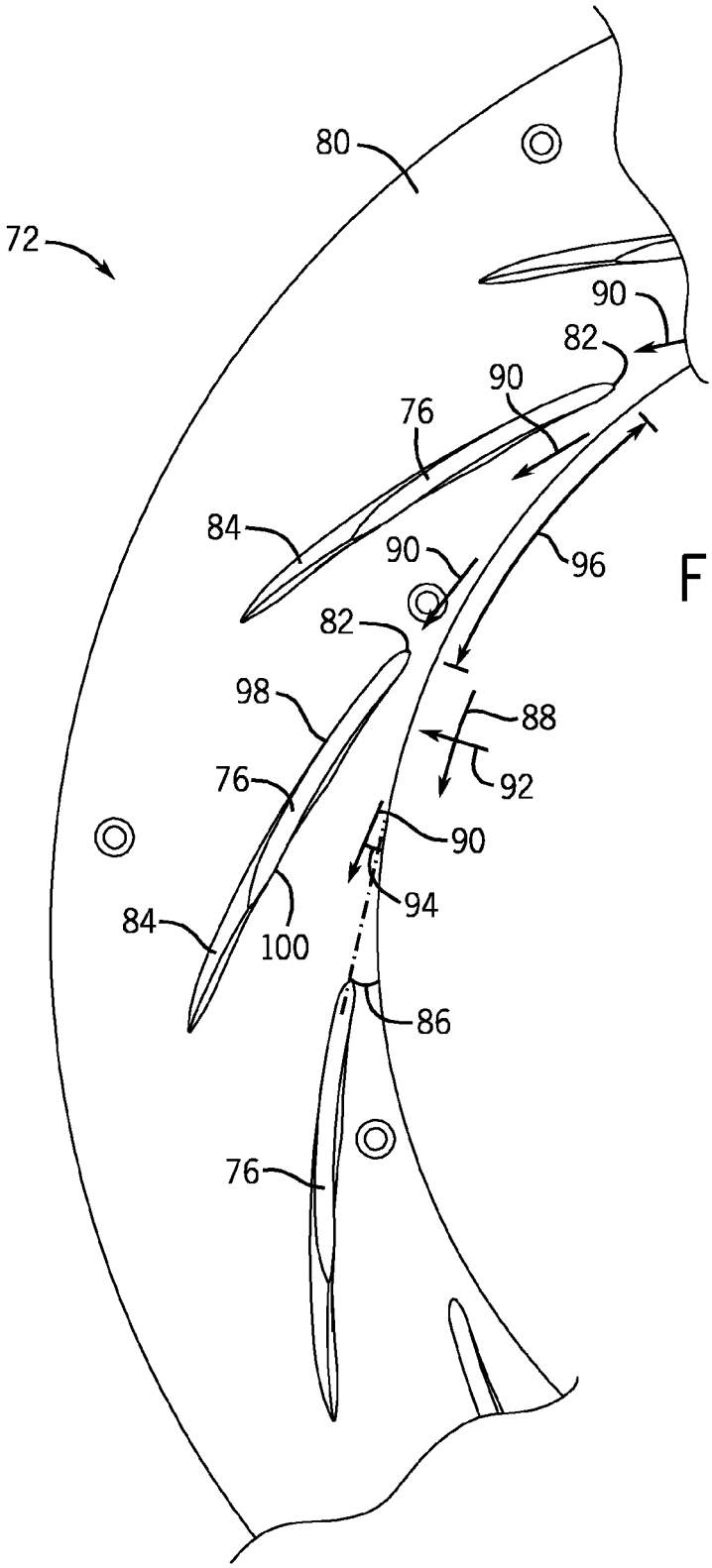
FIG. 5 is a partial axial view of a centrifugal compressor diffuser, as shown in FIG. 4, depicting fluid flow through the diffuser.

FIG. 5 is a partial axial view of the diffuser 72, showing fluid flow expelled from the impeller 48. As illustrated, each vane 76 includes a leading edge 82 and a trailing edge 84. As discussed in detail below, fluid flow from the impeller 48 flows from the leading edge 82 to the trailing edge 84, thereby converting dynamic pressure (i.e., flow velocity) into static pressure (i.e., pressurized fluid). In the present embodiment, the leading edge 82 of each vane 76 is oriented at an angle 86 with respect to a circumferential axis 88 of the plate 80. The circumferential axis 88 follows the curvature of the annual plate 80. Therefore, a 0 degree angle 86 would result in a leading edge 82 oriented substantially tangent to the curvature of the plate 80. In certain embodiments, the angle 86 may be approximately between 0 to 60, 5 to 55, 10 to 50, 15 to 45, to 40, 15 to 35, or about 10 to 30 degrees. In the present embodiment, the angle 86 of each vane 76 may vary between approximately 17 to 24 degrees. However, alternative configurations may employ vanes 76 having different orientations relative to the circumferential axis 88.

As illustrated, fluid flow 90 exits the impeller 48 in both the circumferential direction 88 and a radial direction 92. Specifically, the fluid flow 90 is oriented at an angle 94 with respect to the circumferential axis 88. As will be appreciated, the angle 94 may vary based on impeller configuration, impeller rotation speed, and/or flow rate through the centrifugal compressor system 10, among other factors. In the present configuration, the angle 86 of the vanes 76 is particularly configured to match the direction of fluid flow 90 from the impeller 48. As will be appreciated, a difference between the leading edge angle 86 and the fluid flow angle 94 may be defined as an incidence angle. The vanes 76 of the present embodiment are configured to substantially reduce the incidence angle, thereby increasing the efficiency of the centrifugal compressor system 10.

As previously discussed, the vanes 76 are disposed about the plate 80 in a substantially annular arrangement. A spacing 96 between vanes 76 along the circumferential direction 88 may be configured to provide efficient conversion of the velocity head to pressure head. In the present configuration, the spacing 96 between vanes 76 is substantially equal. However, alternative embodiments may employ uneven blade spacing.

Each vane 76 includes a pressure surface 98 and a suction surface 100. As will be appreciated, as the fluid flows from the leading edge 82 to the trailing edge 84, a high pressure region is induced adjacent to the pressure surface 98 and a lower pressure region is induced adjacent to the suction surface 100. These pressure regions affect the flow field from the impeller 48, thereby increasing flow stability and efficiency compared to vaneless diffusers. In the present embodiment, each three-dimensional non-airfoil vane 76 is particularly configured to match the flow properties of the impeller 48, thereby providing increased efficiency and decreased losses within the surge flow and choked flow regimes.

Figure 6:
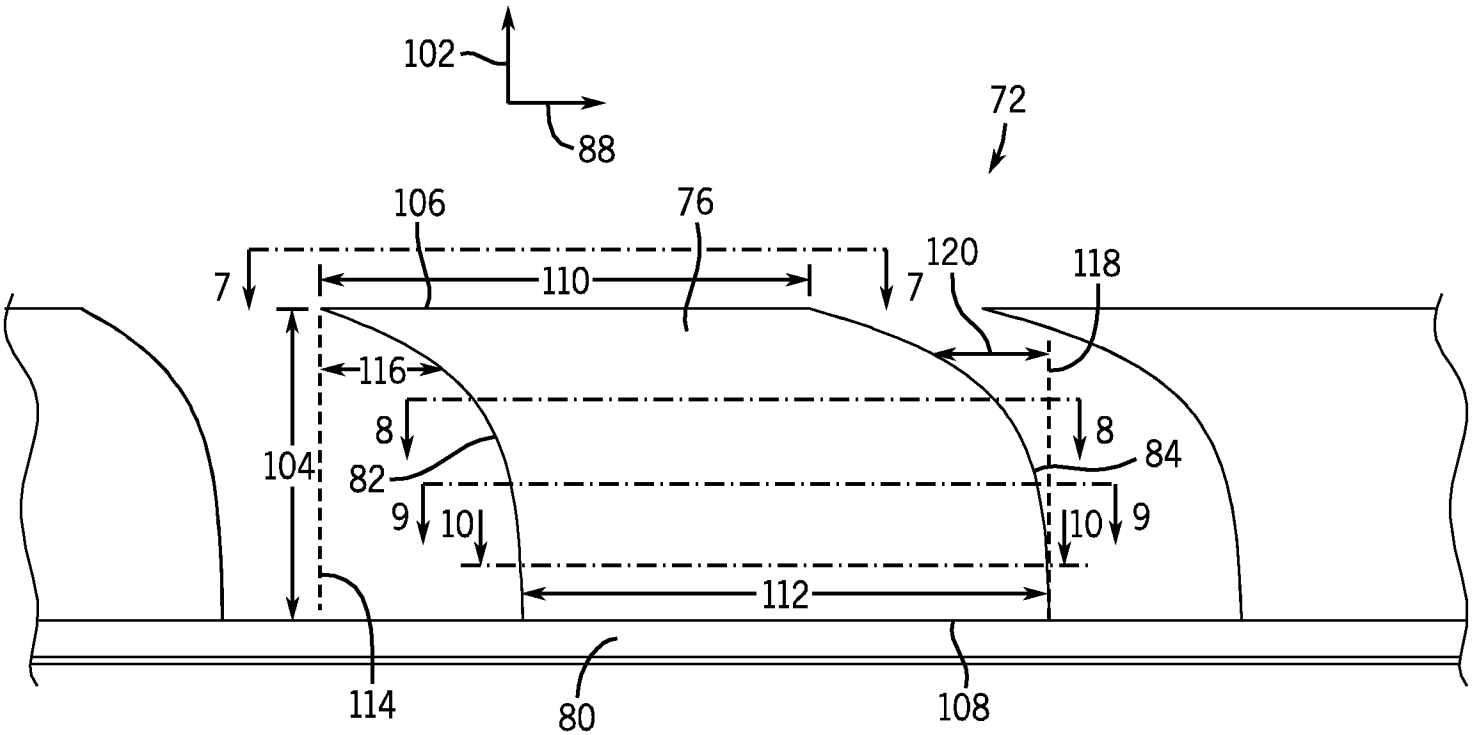
FIG. 6 is a meridional view of the centrifugal compressor diffuser, as shown in FIG. 4, depicting a diffuser vane profile.

FIG. 6 is a meridional view of the centrifugal compressor diffuser 72, showing a diffuser vane profile. Each vane 76 extends along an axial direction 102 between the plate 80 and a shroud (not shown), forming a span 104. Specifically, the span 104 is defined by a vane tip 106 on the shroud side and a vane root 108 on the plate side. As discussed in detail below, a chord length is configured to vary along the span 104 of the vane 76. Chord length is the distance between the leading edge 82 and the trailing edge 84 at a particular axial position along the vane 76. For example, a chord length 110 of the vane tip 106 may vary from a chord length 112 of the vane root 108. A chord length for an axial position (i.e., position along the axial direction 102) of the vane 76 may be selected based on fluid flow characteristics at that particular axial location. For example, computer modeling may determine that fluid velocity from the impeller 48 varies in the axial direction 102. Therefore, the chord length for each axial position may be particularly selected to correspond to the incident fluid velocity. In this manner, efficiency of the vane 76 may be increased compared to configurations in which the chord length remains substantially constant along the span 104 of the vane 76.

In addition, a circumferential position (i.e., position along the circumferential direction 88) of the leading edge 82 and/or trailing edge 84 may be configured to vary along the span 104 of the vane 76. As illustrated, a reference line 114 extends from the leading edge 82 of the vane tip 106 to the plate 80 along the axial direction 102. The circumferential position of the leading edge 82 along the span 104 is offset from the reference line 114 by a variable distance 116. In other words, the leading edge 82 is variable rather than constant in the circumferential direction 88. This configuration establishes a variable distance between the impeller 48 and the leading edge 82 of the vane 76 along the span 104. For example, based on computer simulation of fluid flow from the impeller 48, a particular distance 116 may be selected for each axial position along the span 104. In this manner, efficiency of the vane 76 may be increased compared to configurations employing a constant distance 116. In the present embodiment, the distance 116 increases as distance from the vane tip 106 increases. Alternative embodiments may employ other leading edge profiles, including arrangements in which the leading edge 82 extends past the reference line 114 along a direction toward the impeller 48.

Similarly, a circumferential position of the trailing edge 84 may be configured to vary along the span 104 of the vane 76. As illustrated, a reference line 118 extends from the trailing edge 84 of the vane root 108 away from the plate 80 along the axial direction 102. The circumferential position of the trailing edge 84 along the span 104 is offset from the reference line 118 by a variable distance 120. In other words, the trailing edge 84 is variable rather than constant in the circumferential direction 88. This configuration establishes a variable distance between the impeller 48 and the trailing edge 84 of the vane 76 along the span 104. For example, based on computer simulation of fluid flow from the impeller 48, a particular distance 120 may be selected for each axial position along the span 104. In this manner, efficiency of the vane 76 may be increased compared to configurations employing a constant distance 120. In the present embodiment, the distance 120 increases as distance from the vane root 108 increases. Alternative embodiments may employ other trailing edge profiles, including arrangements in which the trailing edge 84 extends past the reference line 118 along a direction away from the impeller 48. In further embodiments, a radial position of the leading edge 82 and/or a radial position of the trailing edge 84 may vary along the span 104 of the diffuser vane 76.

Figure 7:
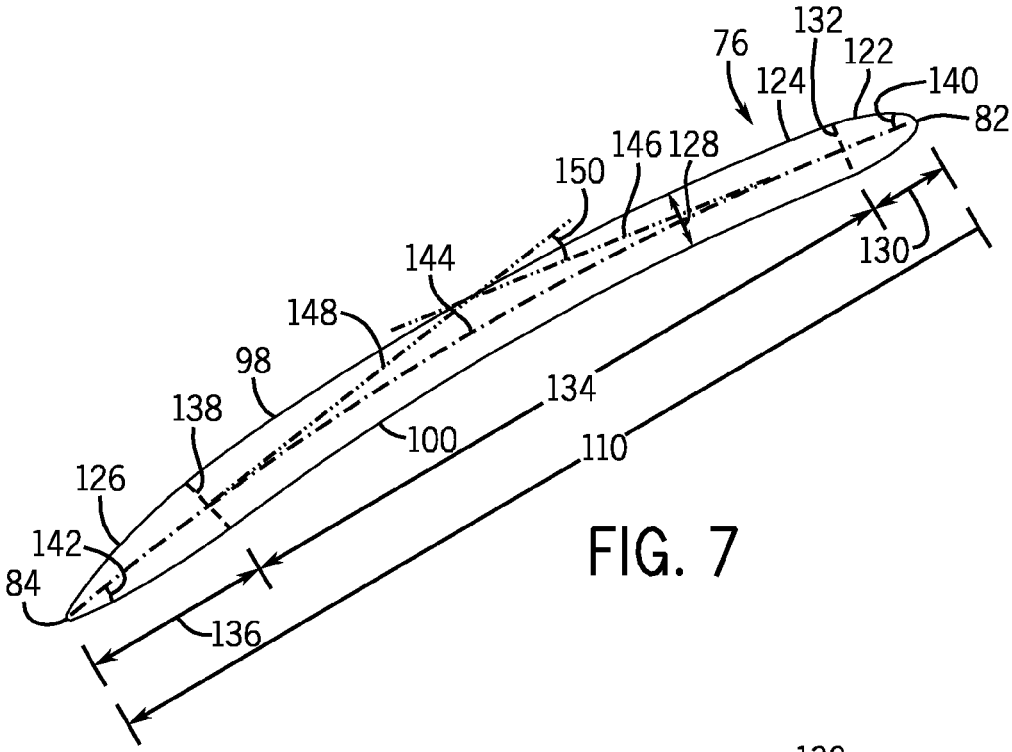
FIG. 7 is a top view of a diffuser vane profile, taken along line 7-7 of FIG. 6.

FIG. 7 is a top view of a diffuser vane profile, taken along line 7-7 of FIG. 6. As illustrated, the vane 76 includes a tapered leading edge section 122, a constant thickness section 124 and a tapered trailing edge section 126. A thickness 128 of the constant thickness section 124 is substantially constant between the leading edge section 122 and the trailing edge section 126. Due to the constant thickness section 124, the profile of the vane 76 is inconsistent with a traditional airfoil. In other words, the vane 76 may not be considered an airfoil-type diffuser vane. However, similar to an airfoil-type diffuser vane, parameters of the vane 76 may be particularly configured to coincide with three-dimensional fluid flow from a particular impeller 48, thereby efficiently converting fluid velocity into fluid pressure.

For example, as previously discussed, the chord length for an axial position (i.e., position along the axial direction 102) of the vane 76 may be selected based on the flow properties at that axial location. As illustrated, the chord length 110 of the vane tip 106 may be configured based on the flow from the impeller 48 at the tip 106 of the vane 76. Similarly, a length 130 of the tapered leading edge section 122 may be selected based on the flow properties at the corresponding axial location. As illustrated, the tapered leading edge section 122 establishes a converging geometry between the constant thickness section 124 and the leading edge 82. As will be appreciated, for a given thickness 128 of a base 132 of the tapered leading edge section 122, the length 130 may define a slope between the leading edge 82 and the constant thickness section 124. For example, a longer leading edge section 122 may provide a more gradual transition from the leading edge 82 to the constant thickness section 124, while a shorter section 122 may provide a more abrupt transition.

In addition, a length 134 of the constant thickness section 124 and a length 136 of the tapered trailing edge section 126 may be selected based on flow properties at a particular axial position. Similar to the leading edge section 122, the length 136 of the trailing edge section 126 may define a slope between the trailing edge 84 and a base 138. In other words, adjusting the length 136 of the trailing edge section 126 may provide desired flow properties around the trailing edge 84. As illustrated, the tapered trailing edge section 126 establishes a converging geometry between the constant thickness section 124 and the trailing edge 84. The length 134 of the constant thickness section 124 may result from selecting a desired chord length 110, a desired leading edge section length 130 and a desired trailing edge section length 136. Specifically, the remainder of the chord length 110 after the lengths 130 and 136 have been selected defines the length 134 of the constant thickness section 124. In certain configurations, the length 134 of the constant thickness section 124 may be greater than approximately 50%, 55%, 60%, 65%, 70%, 75%, or more of the chord length 110. As discussed in detail below, a ratio between the length 134 of the constant thickness section 124 and the chord length 110 may be substantially equal for each cross-sectional profile throughout the span 104.

Furthermore, the leading edge 82 and/or the trailing edge 84 may include a curved profile at the tip of the tapered leading edge section 122 and/or the tapered trailing edge section 126. Specifically, a tip of the leading edge 82 may include a curved profile having a radius of curvature 140 configured to direct fluid flow around the leading edge 82. As will be appreciated, the radius of curvature 140 may affect the slope of the tapered leading edge section 122. For example, for a given length 130, a larger radius of curvature 140 may establish a smaller slope between the leading edge 82 and the base 132, while a smaller radius of curvature 140 may establish a larger slope. Similarly, a radius of curvature 142 of a tip of the trailing edge 84 may be selected based on computed flow properties at the trailing edge 84. In certain configurations, the radius of curvature 140 of the leading edge 82 may be larger than the radius of curvature 142 of the trailing edge 84. Consequently, the length 136 of the tapered trailing edge section 126 may be larger than the length 130 of the tapered leading edge section 122.

Another vane property that may affect fluid flow through the diffuser 72 is the camber of the vane 76. As illustrated, a camber line 144 extends from the leading edge 82 to the trailing edge 84 and defines the center of the vane profile (i.e., the center line between the pressure surface 98 and the suction surface 100). The camber line 144 illustrates the curved profile of the vane 76. Specifically, a leading edge camber tangent line 146 extends from the leading edge 82 and is tangent to the camber line 144 at the leading edge 82. Similarly, a trailing edge camber tangent line 148 extends from the trailing edge 84 and is tangent to the camber line 144 at the trailing edge 84. A camber angle 150 is formed at the intersection between the tangent line 146 and tangent line 148. As illustrated, the larger the curvature of the vane 76, the larger the camber angle 150. Therefore, the camber angle 150 provides an effective measurement of the curvature or camber of the vane 76. The camber angle 150 may be selected to provide an efficient conversion from dynamic head to pressure head based on flow properties from the impeller 48. For example, the camber angle 150 may be greater than approximately 0, 5, 10, 15, 20, 25, 30, or more degrees.

The camber angle 150, the radius of curvature 140 of the leading edge 82, the radius of curvature 142 of the trailing edge 84, the length 130 of the tapered leading edge section 122, the length 134 of the constant thickness section 124, the length 136 of the tapered trailing edge section 126, and/or the chord length 110 may vary along the span 104 of the vane 76. Specifically, each of the above parameters may be particularly selected for each axial cross section based on computed flow properties at the corresponding axial location. In this manner, a three-dimensional vane 76 (i.e., a vane 76 having variable cross section geometry) may be constructed that provides increased efficiency compared to a two-dimensional vane (i.e., a vane having a constant cross section geometry). In addition, as discussed in detail below, the diffuser 72 employing such vanes 76 may maintain efficiency throughout a wide range of operating flow rates.

Figure 8:
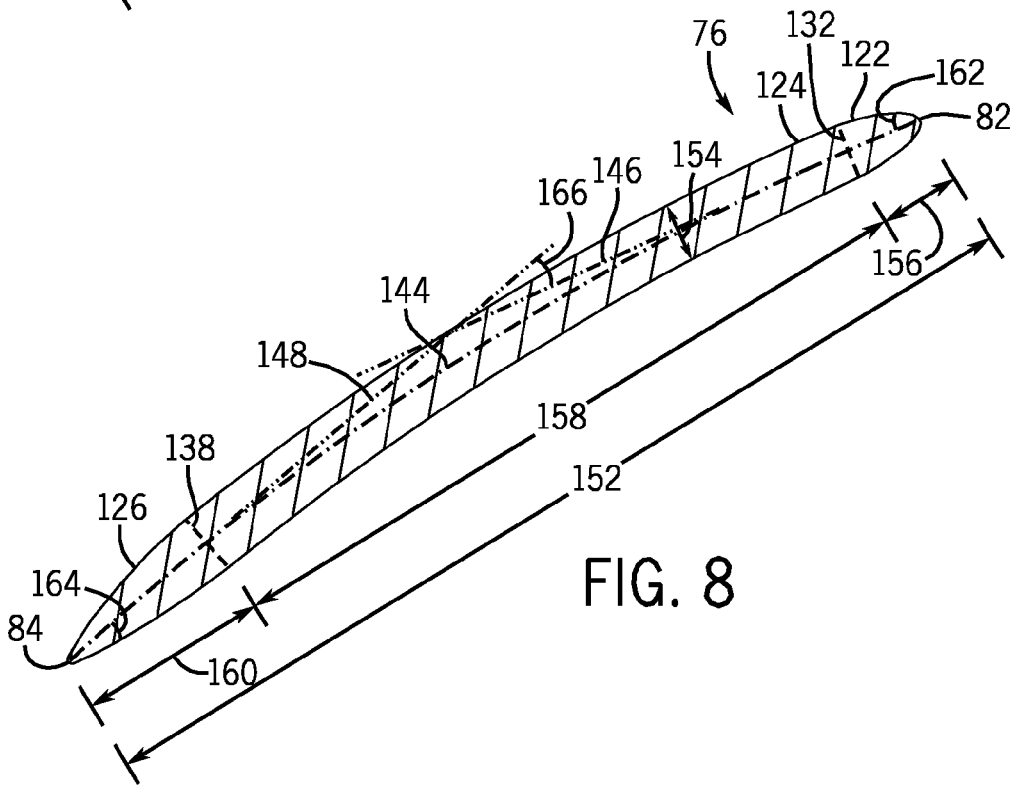
FIG. 8 is a cross section of a diffuser vane, taken along line 8-8 of FIG. 6.

FIG. 8 is a cross section of a diffuser vane 76, taken along line 8-8 of FIG. 6. Similar to the previously discussed profile, the present vane section includes a tapered leading edge section 122, a constant thickness section 124, and a tapered trailing edge section 126. However, the configuration of these sections has been altered to coincide with the flow properties at the axial location corresponding to the present section. For example, the chord length 152 of the present section may vary from the chord length 110 of the vane tip 106. Similarly, a thickness 154 of the constant thickness section 124 may differ from the thickness 128 of the section of FIG. 7. Furthermore, a length 156 of the tapered leading edge section 122, a length 158 of the constant thickness section 124 and/or a length 160 of the tapered trailing edge section 126 may vary based on flow properties at the present axial location. However, a ratio of the length 158 of the constant thickness section 124 to the chord length 152 may be substantially equal to a ratio of the length 134 to the chord length 110. In other words, the constant thickness section length to chord length ratio may remain substantially constant throughout the span 104 of the vane 76.

Similarly, a radius of curvature 162 of the leading edge 82, a radius of curvature 164 of the trailing edge 84, and/or the camber angle 166 may vary between the illustrated section and the section shown in FIG. 7. For example, the radius of curvature 162 of the leading edge 82 may be particularly selected to reduce the incidence angle between the fluid flow from the impeller 48 and the leading edge 82. As previously discussed, the angle of the fluid flow from the impeller 48 may vary along the axial direction 102. Because the present embodiment facilitates selection of a radius of curvature 162 at each axial position (i.e., position along the axial direction 102), the incidence angle may be substantially reduced along the span 104 of the vane 76, thereby increasing the efficiency of the vane 76 compared to configurations in which the radius of curvature 162 of the leading edge 82 remains substantially constant throughout the span 104. In addition, because the velocity of the fluid flow from the impeller 48 may vary in the axial direction 102, adjusting the radii of curvature 162 and 164, chord length 152, chamber angle 166, or other parameters for each axial section of the vane 76 may facilitate increased efficiency of the entire diffuser 72.

Figure 9:
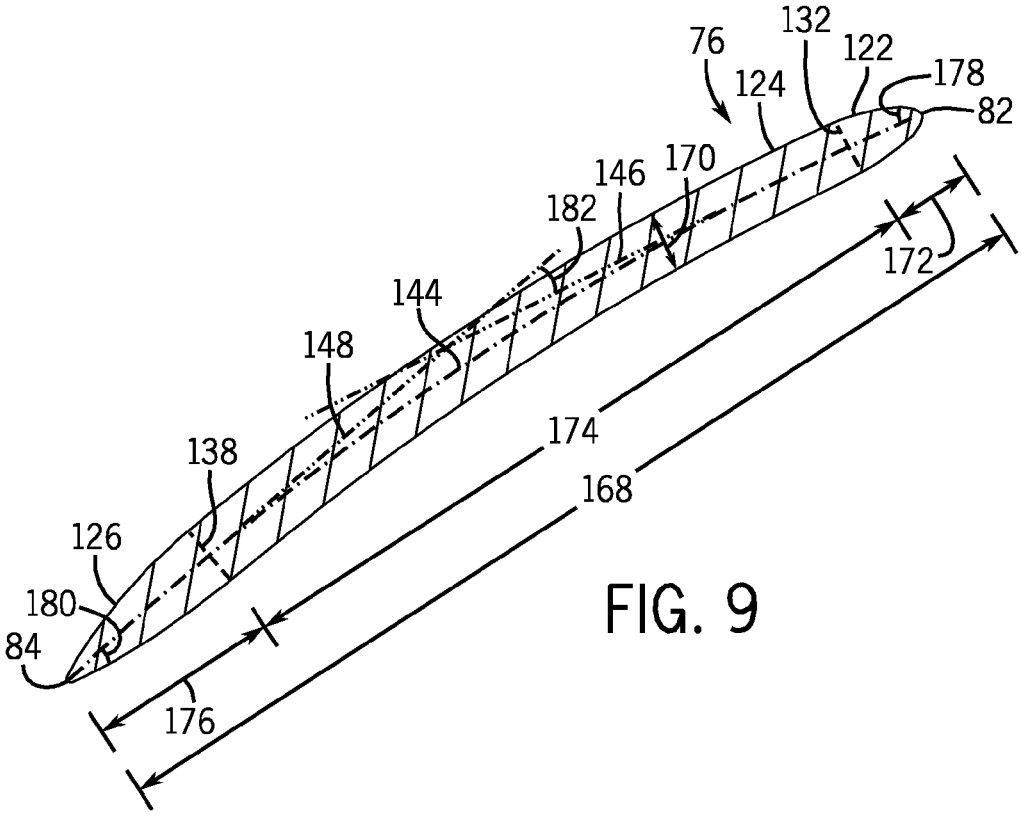
FIG. 9 is a cross section of a diffuser vane, taken along line 9-9 of FIG. 6.

FIG. 9 is a cross section of a diffuser vane 76, taken along line 9-9 of FIG. 6. Similar to the section of FIG. 8, the profile of the present section is configured to match the flow properties at the corresponding axial location. Specifically, the present section includes a chord length 168, a thickness 170 of the constant thickness section 124, a length 172 of the leading edge section 122, a length 174 of the constant thickness section 124, and a length 176 of the trailing edge section 126 that may vary from the corresponding parameters of the section shown in FIG. 7 and/or FIG. 8. In addition, a radius of curvature 178 of the leading edge 82, a radius of curvature 180 of the trailing edge 84, and a camber angle 182 may also be particularly configured for the flow properties (e.g., velocity, incidence angle, etc.) at the present axial location.

Figure 10:
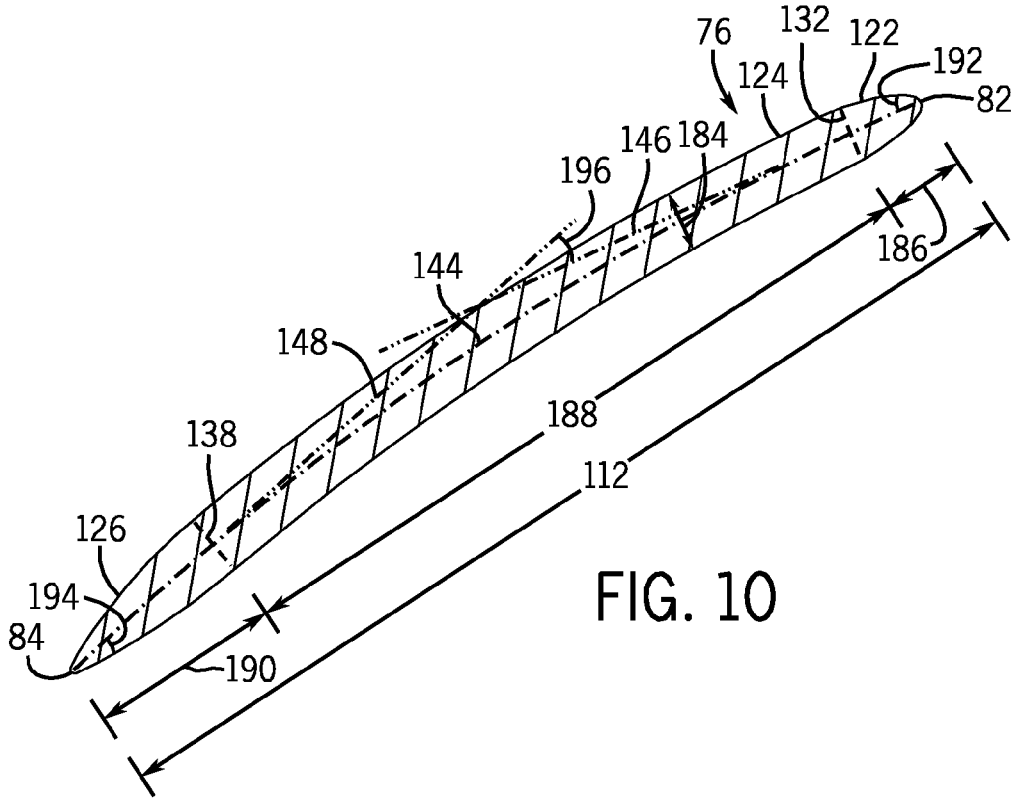
FIG. 10 is a cross section of a diffuser vane, taken along line 10-10 of FIG. 6.

FIG. 10 is a cross section of a diffuser vane 76, taken along line 10-10 of FIG. 6. Similar to the section of FIG. 9, the profile of the present section is configured to match the flow properties at the corresponding axial location. Specifically, the present section includes a chord length 112, a thickness 184 of the constant thickness section 124, a length 186 of the leading edge section 122, a length 188 of the constant thickness section 124, and a length 190 of the trailing edge section 126 that may vary from the corresponding parameters of the section shown in FIG. 7, FIG. 8 and/or FIG. 9. In addition, a radius of curvature 192 of the leading edge 82, a radius of curvature 194 of the trailing edge 84, and a camber angle 196 may also be particularly configured for the flow properties (e.g., velocity, incidence angle, etc.) at the present axial location.

In certain embodiments, the profile of each axial section may be selected based on a two-dimensional transformation of an axial flat plate to a radial flow configuration. Such a technique may involve performing a conformal transformation of a rectilinear flat plate profile in a rectangular coordinate system into a radial plane of a curvilinear coordinate system, while assuming that the flow is uniform and aligned within the original rectangular coordinate system. In the transformed coordinate system, the flow represents a logarithmic spiral vortex. If the leading edge 82 and trailing edge 84 of the diffuser vane 76 are situated on the same logarithmic spiral curve, the diffuser vane 76 performs no turning of the flow. The desired turning of the flow may be controlled by selecting a suitable camber angle. The initial assumption of flow uniformity in the rectangular coordinate system may be modified to involve an actual non-uniform flow field emanating from the impeller 48, thereby improving accuracy of the calculations. Using this technique, a radius of curvature of the leading edge, a radius of curvature of the trailing edge, and/or the camber angle, among other parameters, may be selected, thereby increasing efficiency of the vane 76.

Figure 11:
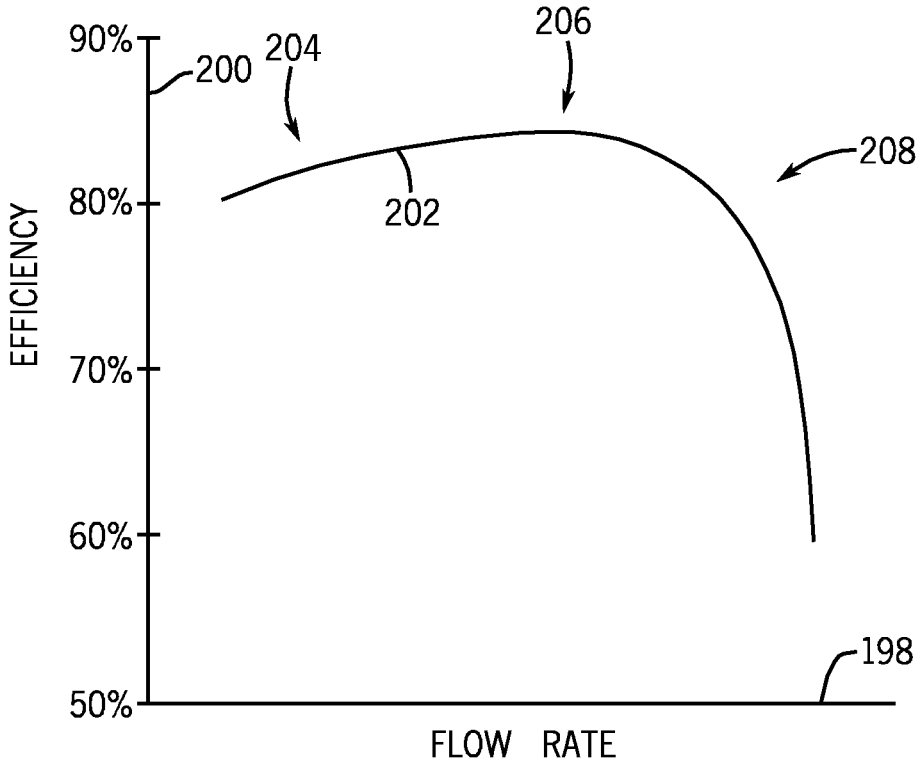
FIG. 11 is a graph of efficiency versus flow rate for a centrifugal compressor that may employ diffuser vanes, as shown in FIG. 4.

FIG. 11 is a graph of efficiency versus flow rate for a centrifugal compressor system 10 that may employ an embodiment of the diffuser vanes 76. As illustrated, a horizontal axis 198 represents flow rate through the centrifugal compressor system 10, a vertical axis 200 represents efficiency (e.g., isoentropic efficiency), and a curve 202 represents the efficiency of the centrifugal compressor system 10 as a function of flow rate. The curve 202 includes a region of surge flow 204, a region of efficient operation 206, and a region of choked flow 208. As will be appreciated, the region 206 represents the normal operating range of the centrifugal compressor system 10. When flow rate decreases below the efficient range, the centrifugal compressor system 10 enters the surge flow region 204 in which insufficient fluid flow over the diffuser vanes 76 causes a stalled flow within the centrifugal compressor system 10, thereby decreasing compressor efficiency. Conversely, when an excessive flow of fluid passes through the diffuser 72, the diffuser 72 chokes, thereby limiting the quantity of fluid that may pass through the vanes 76.

As will be appreciated, configuring vanes 76 for efficient operation includes both increasing efficiency within the efficient operating region 206 and decreasing losses within the surge flow region 204 and the choked flow region 208. As previously discussed, three-dimensional airfoil-type vanes provide high efficiency within the efficient operating region, but decreased performance within the surge and choked flow regions. Conversely, two-dimensional cascade-type diffusers provide decreased losses within the surge flow and choked flow regions, but have reduced efficiency within the efficient operating region. The present embodiment, by contouring each vane 76 to match the flow properties of the impeller 48 and including a constant thickness section 124, may provide increased efficiency within the efficient operating region 206 and decreased losses with the surge flow and choked flow regions 204 and 208. For example, in certain embodiments, the present vane configuration may provide substantially equivalent surge flow and choked flow performance as a two-dimensional cascade-type diffuser, while increasing efficiency within the efficient operating region by approximately 1.5%.

Diffuser vanes 76 are typically manufactured as one-piece diffusers. In other words, the diffuser vanes 76 and the plate 80 are all integrally milled together. However, using the three-dimensional airfoil-type vanes 76 as described above may become more difficult to mill using conventional five-axis (e.g., x, y, z, rotation, and tilt) machining techniques. More specifically, the more complex contours of the three-dimensional diffuser vanes 72 are considerably more difficult to machine than two-dimensional diffuser vanes, which have substantially uniform cross-sectional profiles. As such, machining two-dimensional diffuser vanes entails only a straight extrusion, which may not be possible with the three-dimensional diffuser vanes 76 described herein.

Therefore, the three-dimensional diffuser vanes 76 may be machined separately from the diffuser plate 80, wherein the individual diffuser vanes 76 are attached to the diffuser plate 80 after the diffuser vanes 76 and diffuser plate 80 have been individually machined. Using detachable vanes 76 not only reduces the problem of machining the three-dimensional shape of the diffuser vanes 76, but also reduces or eliminates the presence of fillets, which are concave corners that are created where two machined surfaces (e.g., the diffuser vane 76 and the diffuser hub 80) meet. Reducing or eliminating the presence of fillets may be advantageous for aerodynamic reasons.

Figure 12:
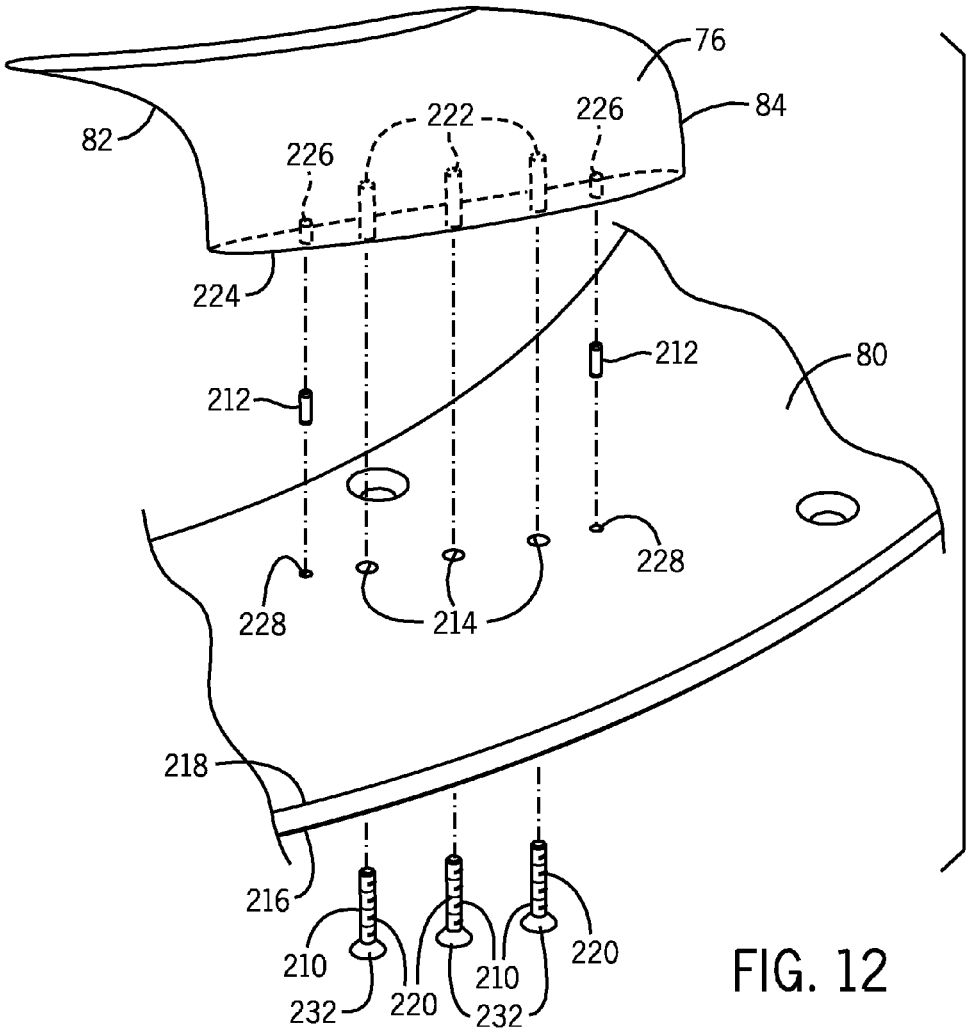
FIG. 12 is a partial exploded perspective view of a diffuser plate and a diffuser vane that is configured to attach to the diffuser plate via fasteners and dowel pins.

However, machining the diffuser vanes 76 and the diffuser plate 80 separately from each other results in the diffuser vanes 76 being separately attached to the diffuser plate 80. The detachable diffuser vanes 76 may be attached to the diffuser plate 80 using any number of suitable fastening techniques. For example, FIG. 12 is a partial exploded perspective view of the diffuser plate 80 and a diffuser vane 76 that is configured to attach to the diffuser plate 80 via fasteners 210 and dowel pins 212. As illustrated, in certain embodiments, for each diffuser vane 76, the diffuser plate 80 may have one or more fastener holes 214 that extend all the way through the diffuser plate 80. The fasteners 210 (e.g., screws, bolts, and so forth) may be inserted through respective fastener holes 214 from a bottom side 216 of the diffuser plate 80 to a top side 218 of the diffuser plate 80, to which the diffuser vanes 76 are attached. As such, in certain embodiments, the fasteners 210 may not be configured to mate with threading within the fastener holes 214. Rather, the outer diameter of threading 220 on the fasteners 210 may generally be smaller than the inner diameter of the fastener holes 214, allowing the fasteners 210 to pass through the respective fastener holes 214. However, the threading 220 of the fasteners 210 is configured to mate with internal threading of respective fastener holes 222 that extend into a bottom side 224 of the diffuser vanes 76.

Figure 13:
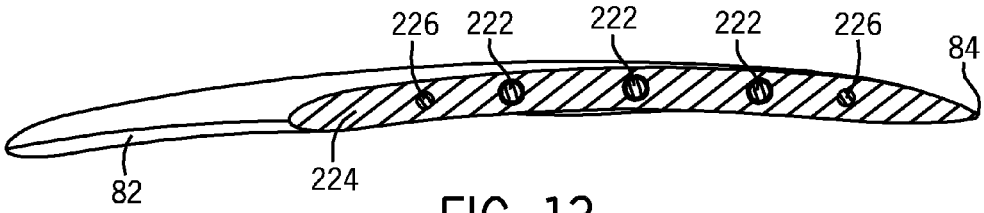
FIG. 13 is a bottom view of the diffuser vane of FIG. 12.

FIG. 13 is a bottom view of the diffuser vane 76 of FIG. 12. As illustrated, the fastener holes 222 extend into the bottom side 224 of the diffuser vanes 76. As also illustrated, one or more alignment holes 226 may extend into the bottom side 224 of the diffuser vanes 76. In the illustrated embodiment, the alignment holes 226 are located on opposite sides (e.g., toward the leading edge 82 and toward the trailing edge 84 of the diffuser vane 76) of the grouping of fastener holes 222. However, in other embodiments, the alignment holes 226 may instead be located between the fastener holes 222. Indeed, the fastener holes 222 and the alignment holes 226 may be located in any pattern relative to each other.

Returning now to FIG. 12, the alignment holes 226 may be configured to mate with dowel pins 212. In addition, the dowel pins 212 may also be configured to mate with alignment holes 228 in the top side 218 of the diffuser plate 80. However, unlike the fastener holes 214, the alignment holes 228 do not extend all the way through the diffuser plate 80. Rather, the alignment holes 228 merely extend partially into the top side 218 of the diffuser plate 80. As such, the dowel pins 212 may be used to align the diffuser vanes 76 with respect to the diffuser plate 80. More specifically, neither the dowel pins 212 nor the alignment holes 226, 228 will contain threading for directly attaching the diffuser vanes 76 to the diffuser plate 80 in certain embodiments. Rather, the dowel pins 212 are used to ensure that the diffuser vanes 76 remain in place with respect to the diffuser plate 80. In certain embodiments, the dowel pins 212 may be smooth, cylindrical shafts. However, in other embodiments, different geometries may be used for the dowel pins 212. In addition, the dowel pins 212 (as well as the various fasteners described herein) may not all be the same shape as each other. For example, in certain embodiments, larger dowel pins 212 may be used toward the leading edges 82 of the diffuser vanes 76, whereas smaller dowel pins 212 may be used toward the trailing edges 84 of the diffuser vanes 76, or vice versa, to ensure proper orientation of the diffuser vanes 76.

Figure 14:
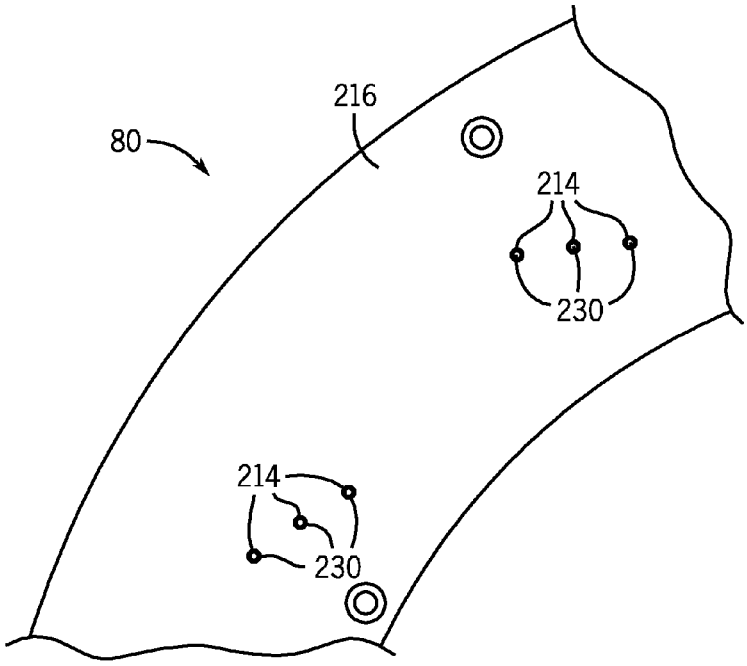
FIG. 14 is a bottom view of the diffuser plate of FIG. 12.

In general, the fastener holes 214 and the alignment holes 228 in the diffuser plate 80 align with the fastener holes 222 and the alignment holes 226 in the diffuser vanes 76, facilitating insertion of the fasteners 210 and the dowel pins 212. FIG. 14 is a bottom view of the diffuser plate 80 of FIG. 12. As illustrated, for each diffuser vane 76, the diffuser plate 80 may have one or more fastener holes 214 that extend all the way through the diffuser plate 80. In addition, in certain embodiments, each fastener hole 214 may be associated with a counter-sunk fastener recess 230 that receives the respective head end 232 of the fasteners 210 illustrated in FIG. 12. Thus, the head ends 232 may be countersunk into the recesses 230, either flush or below the surface 216.

Figure 15:
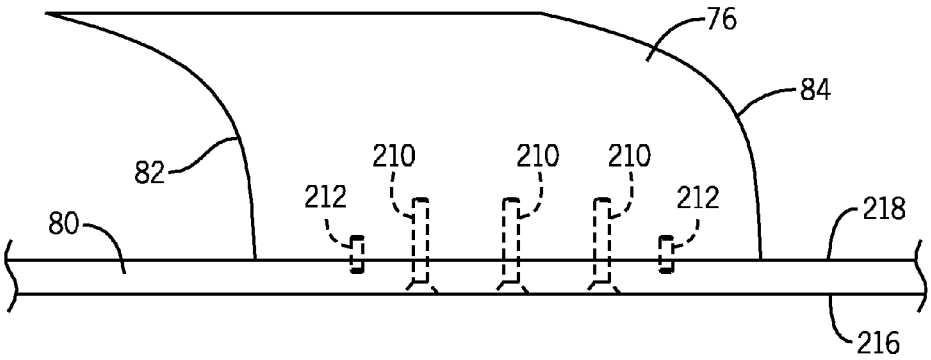
FIG. 15 is a side view of the diffuser vane attached to the diffuser plate of FIG. 12, illustrating the fasteners and dowel pins in place.

The fasteners 210 extending through the fastener holes 214, 222 of the diffuser plate 80 and the diffuser vane 76 ensure that the diffuser vanes 76 remain directly attached to the diffuser plate 80, whereas the dowel pins 212 extending through the alignment holes 228, 226 of the diffuser plate 80 and the diffuser vane 76 aid in alignment of the diffuser vanes 76 with respect to the diffuser plate 80. For example, FIG. 15 is a side view of the diffuser vane 76 attached to the diffuser plate 80 of FIG. 12, illustrating the fasteners 210 and dowel pins 212 in place. It should be noted that, although illustrated in FIGS. 12 through 15 as including three fasteners 210 and two dowel pins 212, any suitable number of fasteners 210 and dowel pins 212 may be used for each diffuser vane 76. For example, In certain embodiments, a minimal use of one fastener 210 and one dowel pin 212 per diffuser vane 76 may be used, with the one fastener 210 attaching the respective diffuser vane 76 to the diffuser plate 80, and the one dowel pin 212 aiding in alignment of the respective diffuser vane 76 with respect to the diffuser plate 80. However, in other embodiments, more than one of each of the fasteners 210 and dowel pins 212 may be used, such as illustrated in FIGS. 12 through 15. For example, in certain embodiments, 1, 2, 3, 4, 5, or more fasteners 210, and 1, 2, 3, 4, 5, or more dowel pins 212 may be used. In addition, in certain embodiments, dowel pins 212 separate from the diffuser vanes 76 may not be used. Rather, the dowel pins 212 may be integrated into the body of the diffuser vanes 76. In other words, the diffuser vanes 76 may include dowel pins 212 that extend from the bottom sides 224 of the diffuser vanes 76. In addition, in other embodiments, the dowel pins 212 may be directly integrated with (e.g., machined from) the diffuser plate 80. Furthermore, the surfaces between the diffuser plate 80 and the diffuser vanes 76 may be flat or non-flat. In other words, in certain embodiments, the surfaces between the diffuser plate 80 and the diffuser vanes 76 may include wedge-fit sections to facilitate connection (e.g., male/female, v-shaped, u-shaped, and so forth).

Figure 16:
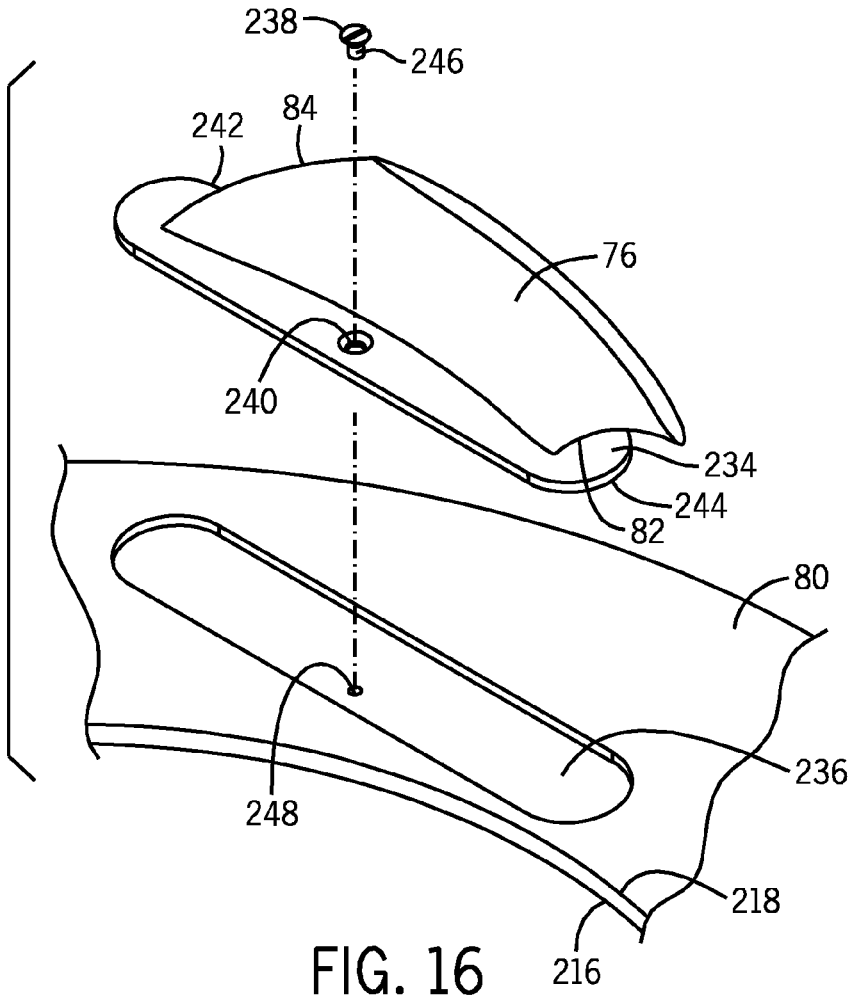
FIG. 16 is a partial exploded perspective view of the diffuser plate and a tabbed diffuser vane configured to attach to the diffuser plate.

Indeed, the embodiments illustrated in FIGS. 12 through 15 are not the only type of attachment that may be used. For example, FIG. 16 is a partial exploded perspective view of the diffuser plate 80 and a tabbed diffuser vane 76 configured to attach to the diffuser plate 80. More specifically, the diffuser vane 76 includes a tab 234 that is configured to mate with a groove 236 in the top side 218 of the diffuser plate 80. The tab 234 may also be referred to as a flange or lip. In the illustrated embodiment, the tab 234 and groove 236 are both elliptically shaped. However, in other embodiments, the tab 234 and groove 236 may include other shapes, such as rectangular, circular, triangular, and so forth. As opposed to the embodiments described above with respect to FIGS. 12 through 15, the shape of the tab 234 and groove 236 aligns the diffuser vane 76 with respect to the diffuser plate 80, thereby reducing any need for multiple fasteners and/or dowel pins. In other words, the tab 234 and groove 236 provide lateral alignment and retention along the surface 218. Although illustrated in FIG. 16 as being symmetrical, in other embodiments, the shape of the tab 234 and groove 236 may be asymmetrical to ensure proper orientation of the diffuser vanes 76 with the diffuser plate 80. In other words, the tab 234 may be shaped asymmetrically, such that it only fits into the groove 236 when properly aligned in the one possible mounting orientation.

Figure 17:
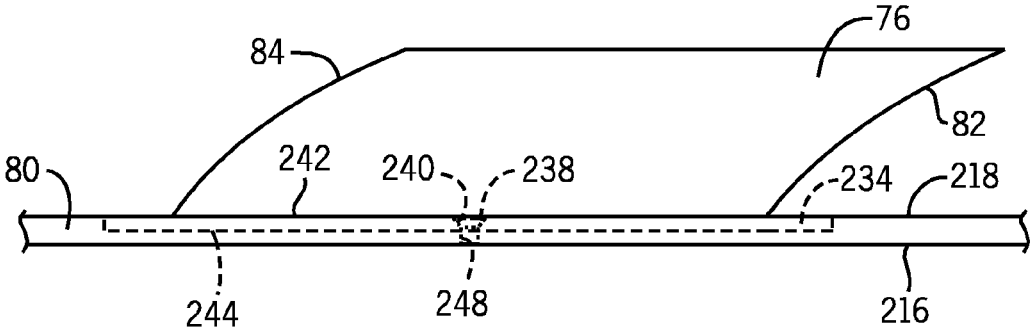
FIG. 17 is a side view of the tabbed diffuser vane attached to the diffuser plate of FIG. 16, illustrating a fastener holding a tab of the diffuser vane in place within a groove of the diffuser plate.

Indeed, as illustrated in FIG. 16, a single fastener 238 may be used to hold the tab 234 axially within its respective groove 236 in the diffuser plate 80. More specifically, the tab 234 of the diffuser vane 76 may include a fastener hole 240 that passes all the way through the tab 234. The fastener 238 (e.g., screw, bolt, and so forth) may be inserted through the fastener hole 240 from a top side 242 of the tab 234 to a bottom side 244 of the tab 234. In certain embodiments, the fastener 238 is not configured to mate with threading within the fastener hole 240. Rather, the outer diameter of threading 246 on the fastener 238 may generally be smaller than the inner diameter of the fastener hole 240, allowing the fastener to pass through the fastener hole 240. However, the threading 246 of the fastener 238 is configured to mate with internal threading of a fastener hole 248 that extends into, but not all the way through, the diffuser plate 80. FIG. 17 is a side view of the tabbed diffuser vane 76 attached to the diffuser plate 80 of FIG. 16, illustrating the fastener 238 holding the tab 234 of the diffuser vane 76 in place within the groove 236 of the diffuser plate 80. Mating surfaces of the tab 234 and groove 236 may be flat or non-flat (e.g., curved or angled, such as v-shaped, u-shaped, and so forth) to create a wedge-fit to help hold the tab 234 and groove 236 together. Although illustrated in FIGS. 16 and 17 as including only one fastener 238, multiple fasteners 238 may actually be used to hold the tab 234 of the diffuser vane 76 in place within the groove 236 of the diffuser plate 80. For example, the number of fasteners 238 used may vary and may include 1, 2, 3, 4, 5, or more fasteners 238.

Figure 18:
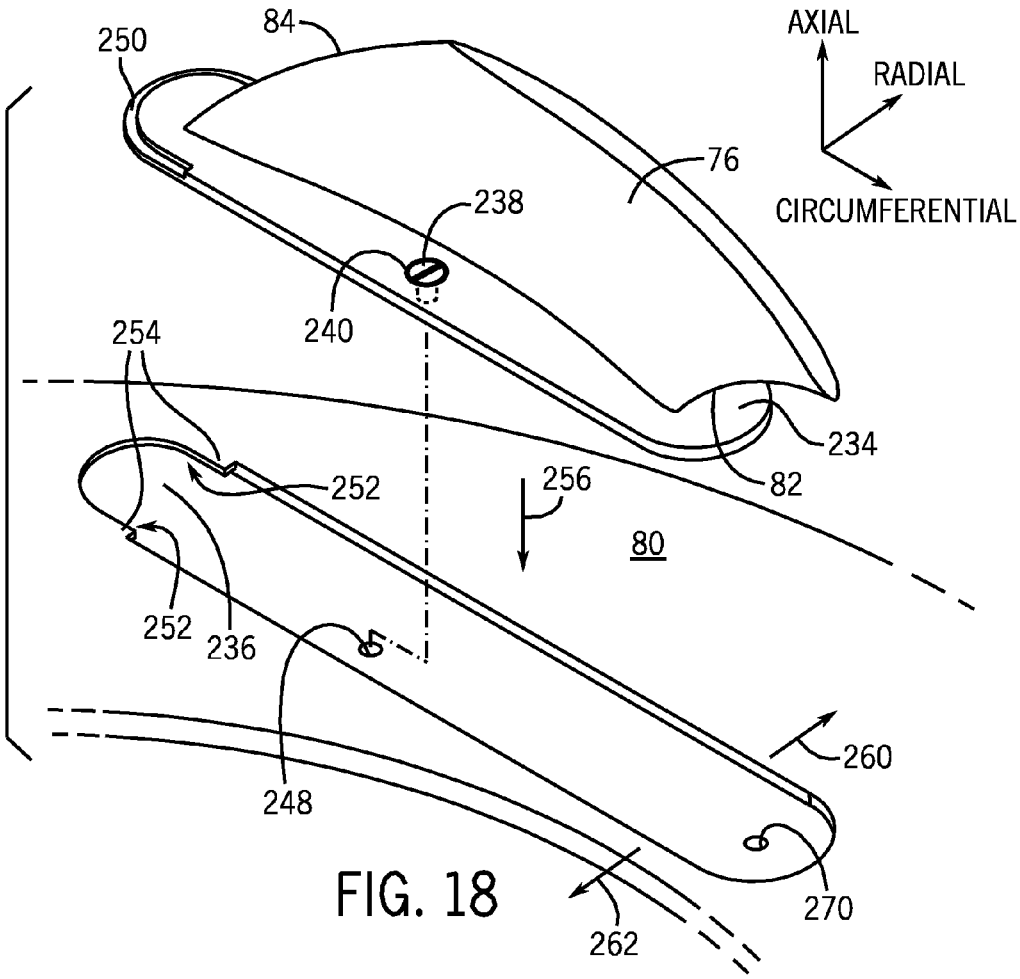
FIG. 18 is a partial exploded perspective view of the diffuser plate and a tabbed diffuser vane having a recessed indention.
Figure 19:
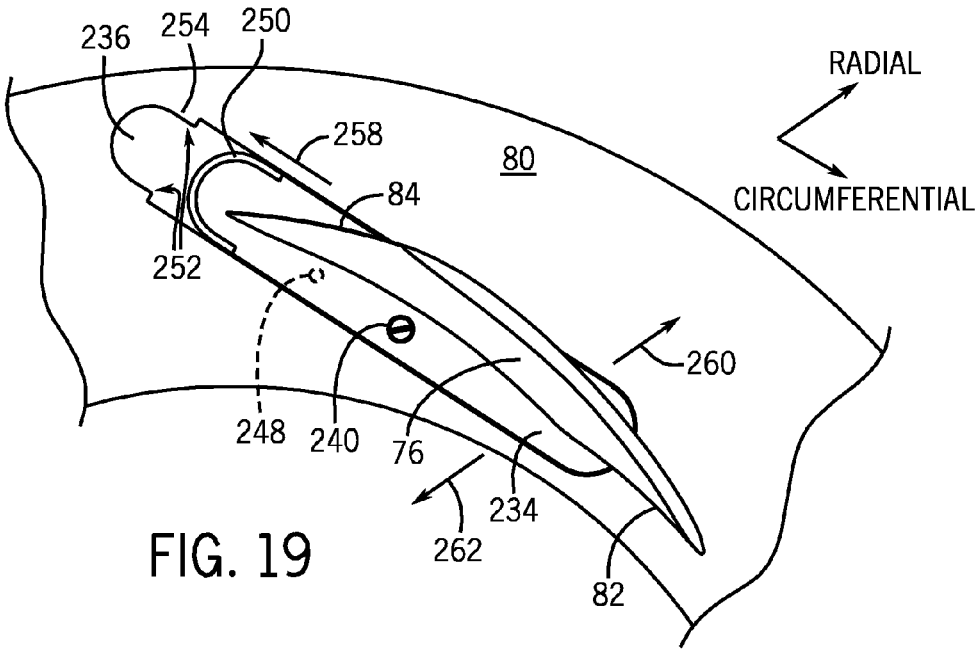
FIG. 19 is a top view of the tabbed diffuser vane inserted into the groove of the diffuser plate of FIG. 18.
Figure 20:
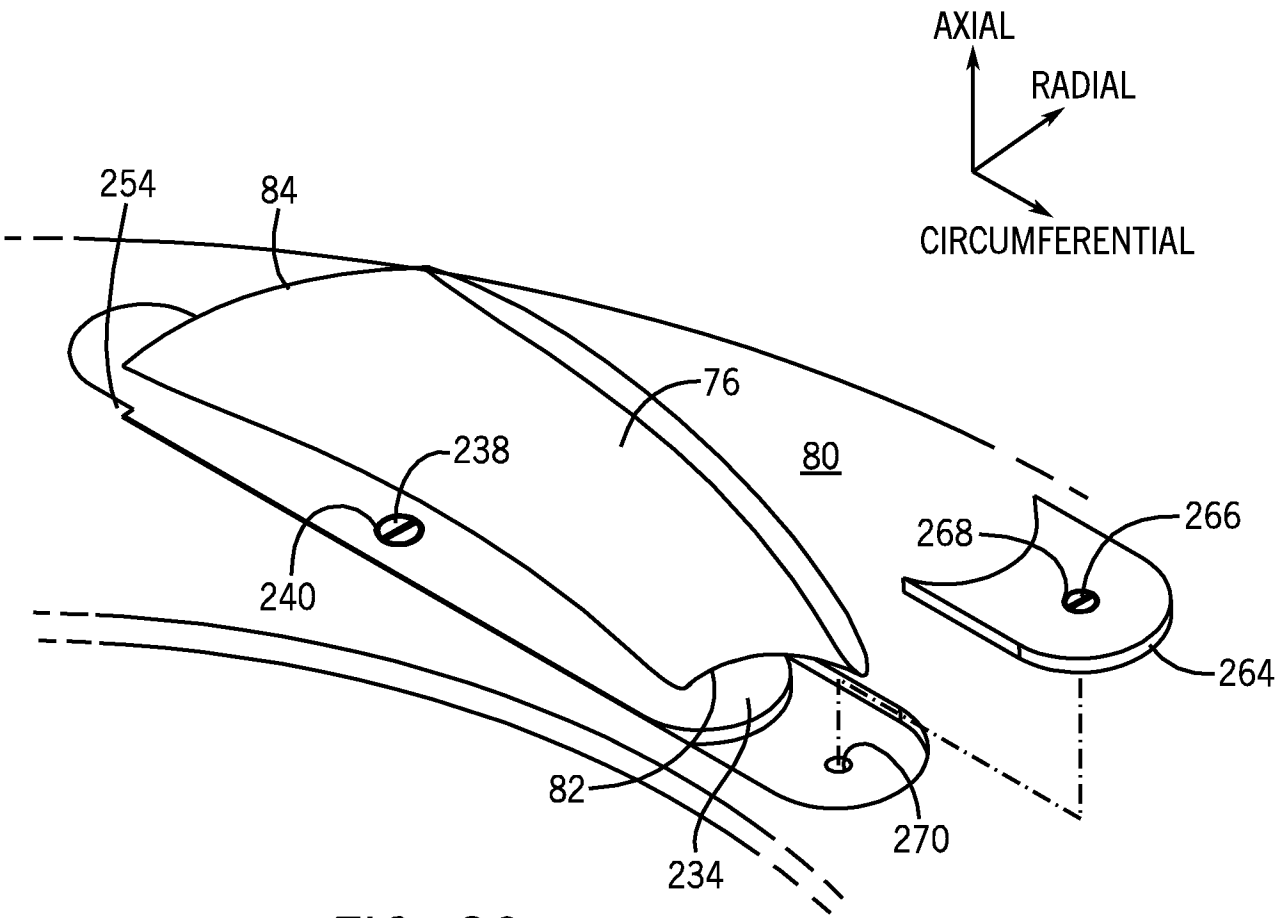
FIG. 20 is a partial exploded perspective view of the diffuser plate and the tabbed diffuser vane of FIGS. 18 and 19, illustrating an insert for filling the open space in the groove next to the tabbed diffuser vane.

The embodiments illustrated in FIGS. 16 and 17 may be extended to use slots, into which the tab 234 of the diffuser vane 76 may be slid. For example, FIG. 18 is a partial exploded perspective view of the diffuser plate 80 and a tabbed diffuser vane 76 having a recessed indention 250 (e.g., a u-shaped indention). As such, the tab 234 of the diffuser vane 76 is configured to slide into a slot 252 defined by an extension 254 (e.g., u-shaped extension or lip) that extends from the top side 218 of the diffuser plate 80 into the volume defined by the groove 236. The recessed indention 250 of the tab 234 may abut the extension 254 when the tab 234 is slid into the slot 252 defined by the extension 254. For example, FIG. 19 is a top view of the tabbed diffuser vane 76 inserted into the groove 236 of the diffuser plate 80 of FIG. 18. Once the tabbed diffuser vane 76 has been inserted into the groove 236 of the diffuser plate 80, as illustrated by arrow 256 in FIG. 18, the tabbed diffuser vane 76 may be slid into the slot 252 defined by the extension 254, as illustrated by arrow 258. More specifically, the tab 234 of the diffuser vane 76 may be slid into the slot 252 between the extension 254 and the groove 236 of the diffuser plate 80, such that the extension 254 aids in axial alignment of the tabbed diffuser vane 76 with respect to the diffuser plate 80. In other words, the extension 254 blocks axial movement of the tabbed diffuser vane 76 away from the surface of the diffuser plate 80. Once the tabbed diffuser vane 76 has been slid into the slot 252, the fastener hole 240 through the tab 234 of the diffuser vane 76 will generally align with the fastener hole 248 in the diffuser plate 80, such that the fastener 238 may be inserted into the fastener holes 240, 248, thereby attaching the tabbed diffuser vane 76 to the diffuser plate 80. In addition, sides of the groove 236 may block movement of the tabbed diffuser vane 76 in a generally radial direction, as illustrated by arrows 260, 262. In addition, once the tabbed diffuser vane 76 has been slid into the slot 252, an insert 264 may be inserted into the open space in the groove 236 next to the tabbed diffuser vane 76. For example, FIG. 20 is a partial exploded perspective view of the diffuser plate 80 and the tabbed diffuser vane 76 of FIGS. 18 and 19, illustrating the insert 264 used for filling the open space in the groove 236 next to the tabbed diffuser vane 76. As illustrated, a fastener 266 may be inserted through a fastener hole 268 in the insert 264 and into a fastener hole 270 in the diffuser plate 80 to secure the insert 264 within the groove 236 next to the tabbed diffuser vane 76. As such, the insert 264 may reduce surface interruptions in the surface 218 of the diffuser plate 80, thereby improving aerodynamic performance.

The embodiments described above with respect to FIGS. 12 through 19 are merely exemplary and not intended to be limiting. For example, although illustrated as including a tabbed diffuser vane 76 that fits into a groove 236 of the diffuser plate 80, the reverse configuration may also be used. In other words, the diffuser plate 80 may include tabs that extend from the surface of the diffuser plate 80, wherein the tabs mate with recessed grooves in the bottom of the diffuser vanes 76. In addition, other fastening techniques for attaching the detachable diffuser vanes 76 to the diffuser plate 80 may be employed. For example, in certain embodiments, the detachable diffuser vanes 76 may be welded or brazed to the diffuser plate 80. However, in these embodiments, the welding may lead to filleted edges between the detachable diffuser vanes 76 and the diffuser plate 80. As such, techniques for minimizing the filleting created by the welding may be employed. For example, in certain embodiments, the detachable diffuser vanes 76 may be inserted into recessed grooves in the diffuser plate 80, similar to those described above, and the welding may be done within spaces between the detachable diffuser vanes 76 and the recessed grooves, thereby minimizing the filleted edges created by the welding.

The detachable three-dimensional diffuser vanes 76 described herein may significantly decrease the complexities of the machining process of the diffuser 72. For example, rather than requiring that the three-dimensional diffuser vanes 76 and the diffuser plate 80 be machined as a single diffuser 72 component, designing the three-dimensional diffuser vanes 76 as detachable diffuser vanes 76 enables the machining of each individual diffuser vane 76 separate from the diffuser plate 80. As such, the only complexities experienced during the machining process are those for the individual detachable, three-dimensional diffuser vanes 76. In addition, the attachment techniques described herein enable attachment of the detachable, three-dimensional diffuser vanes 76 to the diffuser plate 80 while also reducing the amount of filleting between abutting edges of the diffuser vanes 76 and the diffuser plate 80. Reducing the filleting will enhance the aerodynamic efficiency of the diffuser 72.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a centrifugal compressor diffuser having an annular plate and a plurality of detachable vanes attached to the annular plate, wherein each detachable vane of the plurality of detachable vanes comprises a cross-sectional profile that varies along a span of the detachable vane.

2. The system of claim 1, wherein each detachable vane comprises an internally threaded fastener hole on a bottom side of the detachable vane, the annular plate comprises a non-threaded fastener hole extending completely through the annular plate, and the system comprises an externally threaded fastener extending through the non-threaded fastener hole and into the internally threaded fastener hole to attach the detachable vane to the annular plate.

3. The system of claim 2, wherein each detachable vane is associated with a dowel pin configured to align the detachable vane with respect to the annular plate.

4. The system of claim 3, wherein the dowel pin is integral to and extends from the bottom side of the diffuser vane.

5. The system of claim 3, wherein each diffuser vane is associated with two or more threaded fasteners and two or more dowel pins.

6. The system of claim 1, wherein each diffuser vane comprises a tab on a bottom side of the detachable vane, and the tab plate is configured to fit securely within a groove in a top side of the annular plate.

7. The system of claim 6, wherein the tab comprises a non-threaded fastener hole extending completely through the tab, the annular plate comprises an internally threaded fastener hole in the groove, and the system comprises an externally threaded fastener extending through the non-threaded fastener hole and into the internally threaded fastener hole to attach the tab to the annular plate.

8. The system of claim 6, wherein the tab comprises an indention on a top side of the tab, and the annular plate comprises an extension configured to mate with the indention on the tab.

9. The system of claim 8, wherein the tab is configured to slide in a direction along the top side of the annular plate into a slot between the extension and the groove of the annular plate.

10. The system of claim 6, wherein the tab and the groove are both elliptically shaped.

11. A system, comprising:

a detachable centrifugal compressor diffuser vane, wherein the detachable centrifugal compressor diffuser vane comprises a cross-sectional profile that varies along a span of the detachable vane.

12. The system of claim 11, wherein the detachable centrifugal compressor diffuser vane comprises a first threaded fastener configured to mate with a second threaded fastener to attach the detachable centrifugal compressor diffuser vane to a centrifugal compressor diffuser plate.

13. The system of claim 12, comprising a dowel pin that aligns the detachable centrifugal compressor diffuser vane with respect to the centrifugal compressor diffuser plate.

14. The system of claim 13, wherein the dowel pin extends from a bottom side of the detachable centrifugal compressor diffuser vane, and the dowel pin is configured to mate with a non-threaded alignment hole of the centrifugal compressor diffuser plate.

15. The system of claim 11, wherein the detachable centrifugal compressor diffuser vane comprises a tab configured to fit securely within a groove of a centrifugal compressor diffuser plate.

16. The system of claim 15, wherein the tab comprises an indention on a top side of the tab, the indention is configured to mate with an extension from the centrifugal compressor diffuser plate, and the tab is configured to slide in a direction along a top surface of the centrifugal compressor diffuser plate into a slot between the extension and the groove of the centrifugal compressor diffuser plate.

17. The system of claim 16, wherein the tab is elliptically shaped, the indention is u-shaped, and the extension is u-shaped.

18. A system, comprising:

a centrifugal compressor comprising a centrifugal compressor diffuser having a plurality of detachable diffuser vanes attached to a diffuser plate, wherein each detachable diffuser vane of the plurality of detachable diffuser vanes comprises a cross-sectional profile that varies along a span of the detachable diffuser vane.

19. The system of claim 18, wherein each detachable diffuser vane is attached to the diffuser plate by one or more threaded fasteners.

20. The system of claim 18, wherein each detachable diffuser vane comprises a tab configured to fit within a groove of the diffuser plate.

21. A system, comprising:

a detachable centrifugal compressor diffuser vane, wherein the detachable centrifugal compressor diffuser vane comprises a tab configured to fit securely within a groove of a centrifugal compressor diffuser plate.

22. The system of claim 21, comprising a centrifugal compressor diffuser having the centrifugal compressor diffuser plate and the detachable centrifugal compressor diffuser vane.

23. The system of claim 21, comprising a centrifugal compressor having the centrifugal compressor diffuser plate and the detachable centrifugal compressor diffuser vane.

* * * * *